US006653546B2

(12) United States Patent
Jameson

(10) Patent No.: US 6,653,546 B2
(45) Date of Patent: Nov. 25, 2003

(54) VOICE-CONTROLLED ELECTRONIC MUSICAL INSTRUMENT

(75) Inventor: John W. Jameson, San Carlos, CA (US)

(73) Assignee: Alto Research, LLC, San Carlos, CA (US)

( * ) Notice: Subject to any disclaimer, the term of this patent is extended or adjusted under 35 U.S.C. 154(b) by 0 days.

(21) Appl. No.: 10/246,485

(22) Filed: Sep. 18, 2002

(65) Prior Publication Data

US 2003/0066414 A1 Apr. 10, 2003

Related U.S. Application Data

(63) Continuation-in-part of application No. 09/979,340, filed on Nov. 20, 2001.
(60) Provisional application No. 60/327,072, filed on Oct. 3, 2001.

(51) Int. Cl.[7] ..... G10H 1/06
(52) U.S. Cl. ..... 84/735; 84/616
(58) Field of Search ..... 84/616, 654, 735, 84/743, 610, 611, 650, 651

(56) References Cited

U.S. PATENT DOCUMENTS 4,463,650 A * 8/1984 Rupert ..... 84/654
4,771,671 A * 9/1988 Hoff, Jr. ..... 84/645
4,915,001 A * 4/1990 Dillard ..... 84/600
5,428,708 A * 6/1995 Gibson et al. ..... 704/270
5,770,813 A * 6/1998 Nakamura ..... 84/610
6,369,311 B1 * 4/2002 Iwamoto ..... 84/615
6,372,973 B1 * 4/2002 Schneider ..... 84/609

* cited by examiner

*Primary Examiner*—Jeffrey Donels
(74) *Attorney, Agent, or Firm*—Glenn Patent Group; Michael A. Glenn; Christopher Peil

(57) ABSTRACT

An electronic, voice-controlled musical instrument called the Vocolo, in which the player hums into the mouthpiece, and the device imitates the sound of a musical instrument whose pitch and volume change in response to the player's voice is disclosed. The player is given the impression of playing the actual instrument and controlling it intimately with the fine nuances of his voice. The invention comprises techniques for pitch quantization that provide esthetically pleasing note transitions, mechanisms for song recording that are suited for rhythmic repeated playback and performance evaluation of the player's pitch control, techniques related to expressive control and pitch detection, and techniques for mitigating the effect of pitch detection errors. Embodiments are disclosed for providing finger/hand interaction for expressive control, a microphone enclosure that mitigates audio feedback, and for providing rhythmic feedback to the player through mechanical vibrations induced in the device.

21 Claims, 21 Drawing Sheets

VOICE-CONTROLLED ELECTRONIC MUSICAL INSTRUMENT

CROSS REFERENCE TO RELATED APPLICATIONS

This application claims priority to U.S. Provisional Patent Application No. 60/327,072 filed Oct. 3, 2001 and is a Continuation-in-Part of U.S. Ser. No. 09/979,340, filed Nov. 21, 2001.

BACKGROUND OF THE INVENTION

1. Technical Field

The invention relates to musical instruments. More particularly, the invention relates to a voice-controlled electronic musical instrument.

2. Description of the Prior Art

Musical instruments have traditionally been difficult to play, thus requiring a significant investment of time and, in some cases money, to learn the basic operating skills of that instrument. In addition to frequent and often arduous practice sessions, music lessons would typically be required, teaching the mechanical skills to achieve the proper musical expression associated with that instrument, such as pitch, loudness, and timbre. In addition, a musical language would be taught so that the user would be able to operate the instrument to play previously written songs.

The invention relates to a hand-held music synthesizer whose output is controlled by the human voice, referred to herein as "Vocolo™." The principles and features of the Vocolo were set forth in the patent application entitled "Voice Controlled Electronic Musical Instrument," PCT Serial No. PCT/US00/13721, henceforth referred to as the "Reference Patent Application." Note that alternate names of the Vocolo™ used in the reference document were "HumHorn™" and "HumBand™." The Vocolo is an electronic, voice-controlled musical instrument. It is in essence an electronic kazoo. The player hums into the mouthpiece, and the device imitates the sound of a musical instrument whose pitch and volume change in response to the player's voice. The player is given the impression of playing the actual instrument and controlling it intimately with the fine nuances of his voice.

The evolution of musical instruments has been relatively slow, with few new musical-instrument products taking hold over the past several hundred years. The introduction of electronics-related technology, however, has had a significant impact on musical-instrument product development. The music synthesizer, for example, together with the piano keyboard interface/controller, has vastly expanded the number and variety of instrument sounds which can be produced by a person who has learned to play a single instrument—that of piano or keyboards. The requirement remained, however, that for someone to operate a synthesizer, that person would have to learn at least some of the fundamentals of music expression associated with playing a piano.

Therefore, for those people who wanted to be able to express themselves musically, but had not learned to play an instrument, or wanted to be able to make many instrument sounds without learning how to play each instrument, there was still a significant time investment required to learn the skill, with no assurance that they could ever reach a level of proficiency acceptable to them.

In U.S. Pat. Nos. 3,484,530 and 3,634,596 there are disclosed systems for producing musical outputs from a memory containing recorded musical notes that can be stimulated by single note inputs through a microphone. The systems disclosed in these patents are reportedly able to detect pitch, attack, sustain, and decay as well as volume level and are able to apply these sensed inputs to the recorded note being played back. In effect, the systems are musical note to musical note converters that may be converted fast enough so that no lag can be detected by the listener or by the player. However, to achieve these capabilities, rather cumbersome and expensive electronic and mechanical means were suggested, which are not suited for portable or handheld instruments, but primarily intended for larger systems.

In the systems disclosed in the above patents, the memory is capable of containing discrete notes of the chromatic scale and respond to discrete input notes of the same pitch. The system is analogous to a keyboard instrument where the player has only discrete notes to choose from and actuates one by depressing that particular key. Other musical instruments give a player a choice of pitches between whole and half tone increments. For example, a violin can produce a pitch which is variable depending upon where the string is fretted or a slide trombone can cause a pitch falling in between whole and half tone increments. Both of these instruments produce an unbroken frequency spectrum of pitch. However, such prior art systems are not able to provide a continually varying pitch at the output in response to a continually varying pitch at the input, nor have they been able to produce a note timbre that realistically duplicates what a real instrument does as a function of pitch over the range of the instrument nor provide a note quality or timbre which realistically duplicates what a real instrument does as a function of degree of force at the input of an instrument.

A variety of other methods have been proposed to use the human voice to control a synthesizer, thus taking advantage of the singular musical expression mechanism which most people have. Virtually anyone who can speak has the ability to change musically expressive parameters such as pitch and loudness. One such method is described in R. Rupert, U.S. Pat. No. 4,463,650 (Aug. 7, 1984). In the Rupert device, real instrumental notes are contained in a memory with the system responsive to the stimuli of, what he refers to as "mouth music" to create playable musical instruments that responds to the mouth music stimuli in real time. See, also, K. Obata, Input apparatus of electronic device for extracting pitch from input waveform signal, U.S. Pat. No. 4,924,746 (May 15, 1990).

Ishikawa, Sakata, Obara, Voice Recognition Interval Scoring System, European Pat. No. 142,935 (May 29, 1985), recognizing the inaccuracies of the singing voice "contemplates providing correcting means for easily correcting interval data scored and to correct the interval in a correcting mode by shifting cursors at portions to be corrected." In a similar attempt to deal with vocal inaccuracies, a device described by M. Tsunoo et al, U.S. Pat. No. 3,999,456 (Dec. 28, 1976) uses a voice keying system for a voice-controlled musical instrument which limits the output tone to a musical scale. The difficulty in employing either the Ishikawa or the Tsunoo devices for useful purposes is that most untrained musicians do not know which scales are appropriate for different songs and applications. The device may even be a detractor from the unimproved voice-controlled music synthesizer, due to the frustration of the user not being able to reach certain notes he desires to play.

In a related area, the concept of "music-minus-one" is the use of a predefined usually prerecorded musical background to supply contextual music around which a musician/user sings or plays an instrument, usually the lead part. This concept allows the user to make fuller sounding music, by playing a key part, but having the other parts played by other musicians. Benefits to such an experience include greater entertainment value, practice value and an outlet for creative expression.

M. Hoff, Entertainment and creative expression device for easily playing along to background music, U.S. Pat. No. 4,771,671 (Sep. 20, 1988) discloses an enhancement to the music minus-one concept, providing a degree of intelligence to the musical instrument playing the lead the voice-controlled music synthesizer, in this case so as not to produce a note which sounds dissonant or discordant relative to the background music. In addition, Hoff discloses a variation on the voice-controlled music synthesizer by employing correction. Rather than correcting the interval in an arbitrary manner, as suggested in the Tsunoo and Ishikawa patents, this device adjusts the output of the music synthesizer to one which necessarily sounds good to the average listener, relative to predefined background music. However, Hoff performs pitch correction only in the context of pre-programmed accompaniments, using the scale note suggested by the accompaniment nearest to the detected pitch. Hoff does not provide pitch correction in the absence of accompaniment, for example, the capability for the user to choose the scale to be used for the pitch correction or the capability to assign the currently detected pitch to the tonic of that scale. Various approaches to the process of pitch detection itself are known. For example, see M. Russ, *Sound Synthesis and Sampling,* Focal Press, 1996, p. 265, or L. Rabiner et. al., *A Comparative Performance Study of Several Pitch Detection Algorithms,* IEEE Transactions on Acoustics, Speech, and Signal Processing, Vol. ASSP-24, No. 5, October 1976, p. 399. According to Russ, the traditional general classifications for pitch detection are a) zero-crossing, b) auto-correlation, c) spectral interpretation.

Autocorrelation is currently probably the most popular method used commercially today for pitch detection. Three auto-correlation approaches that bear some resemblance to the present approach are, for example, S. Dame, *Method and Device For Determining The Primary Pitch of A Music Signal*, U.S. Pat. No. 5,619,004 (Apr. 8, 1997) and M. J. Ross, H. L. Shaffer, A. Cohen, R. Freudberg, and H. J. Manley, *Average Magnitude Difference Function Pitch Extractor,* IEEE Trans. on Acoustics, Speech, and Signal Processing, Vol. ASSP-22, No. 5 (October 1974). Hildebrand, H. A., *Pitch Detection and Intonation Correction Apparatus and Method,* U.S. Pat. No. 5,973,252 (Oct. 26, 999). F. Mekuria, Detection of periodicity information from an audio signal, U.S. Pat. No. 5,970,441 (Oct. 19, 1999) discloses a method of pitch detection emphasizing peaks in a (low pass) filtered audio signal.

A major drawback of all presently known systems that allow voice control of a musical instrument is that they require bulky enclosures and are presented in unfamiliar form factors, i.e. as imposing pieces of technical equipment. Thus, a user is unable to connect with such instruments in a natural way. Rather than playing a musical instrument, such devices give one the impression of operating a piece of machinery that, in most cases, is similar to operating a computer. This fact alone well explains the lack of commercial success and consumer acceptance these devices have found.

It would be advantageous to provide a voice-controlled musical instrument in a form factor similar to an actual instrument. It would be further advantageous if such form factor contributed to the ease of use of such instrument by providing a user with a simple method of operation. It would also be advantageous to provide a computationally efficient pitch detection technique for a voice-controlled electronic musical instrument, such that a reduced size form factor, as well as an economical price, could be achieved.

Given that no pitch detection method is perfect and that there will always be some errors, it would also be advantageous to provide means for reducing the errors and/or mitigating the effect of these errors on the sound quality of the instrument synthesis.

It would further be advantageous to provide features that allow the player to take advantage of the Vocolo's unique style of control. For virtually any other musical instrument the hands are preoccupied with just playing the notes. With the Vocolo the hands are free to control nuances of the performance such as vibrato, volume (and tremelo), and timbre control. The voice of the player can also be used to control nuances as well, providing an arsenal for creating unique and powerful performances.

The Vocolo provides a visceral experience when held in the hands because its sound output can be felt through its body. To accentuate this attribute it would be advantageous to provide a special means for transmitting mechanical pulses through the body of the Vocolo that corresponds to a precise background rhythm.

The Vocolo can be a great tool for improvisation and for the creation of personal compositions. For this purpose, it would be advantageous to allow a player to "jam" by himself. That is, to be able to record a sequence of notes as a background accompaniment, and then be able to play along with this accompaniment.

The voice interface for the Vocolo lends itself well to gaming applications because it can recognize patterns in the pitch and timing of notes. Thus it would be advantageous to provide a means for vocal pattern recognition, as well as different ways to utilize such a capability for different kinds of games.

SUMMARY OF THE INVENTION

The invention relates to a hand-held music synthesizer whose output is controlled by the human voice, presently called the Vocolo. The Vocolo is an electronic, voice-controlled musical instrument. The player hums into the mouthpiece, and the device imitates the sound of a musical instrument whose pitch and volume change in response to the player's voice.

The player is given the impression of playing the actual instrument and controlling it intimately with the fine nuances of his voice. The instrument can in principle be any music-producing sound source: a trumpet, trombone, saxophone, oboe, bassoon, clarinet, flute, piano, electric guitar, voice, whistle, i.e. virtually any source of sound.

The Reference Patent Application describes three primary software components of the Vocolo: the frequency-detection module, the loudness-tracking module, and the note-attack module. The frequency-detection module (FDM) identifies the frequency of the player's voice. The chosen instrument is synthesized at the pitch determined by the FDM or at an offset from that pitch as desired by the player. The loudness-tracking component measures the loudness of the player's voice, and this information is used then to set the volume of the synthesized sound. The note-attack module detects abrupt changes in the loudness of the player's voice, which helps decide when the synthesized instrument should begin a new note.

One aspect of the present invention sets forth a refinement of the Vocolo hardware in the form of improved microphone interfaces. Alternative embodiments are also set forth, which comprise an electric drum for feeding back automatic background rhythm to the player, and a wiggle bar for expression control. Also disclosed are a smoother form of pitch discretization and a novel approach for mitigating pitch detection errors in the synthesis. Software methods for performance evaluation, sequence recording and playback, pitch smoothing, and novel use of the voice for expressive control, are also set forth.

Figure 7:
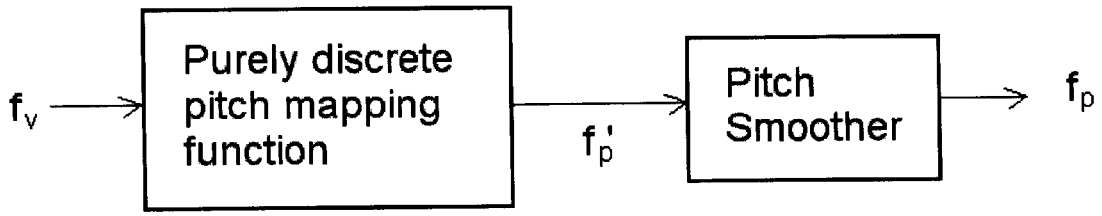
Figure 8:
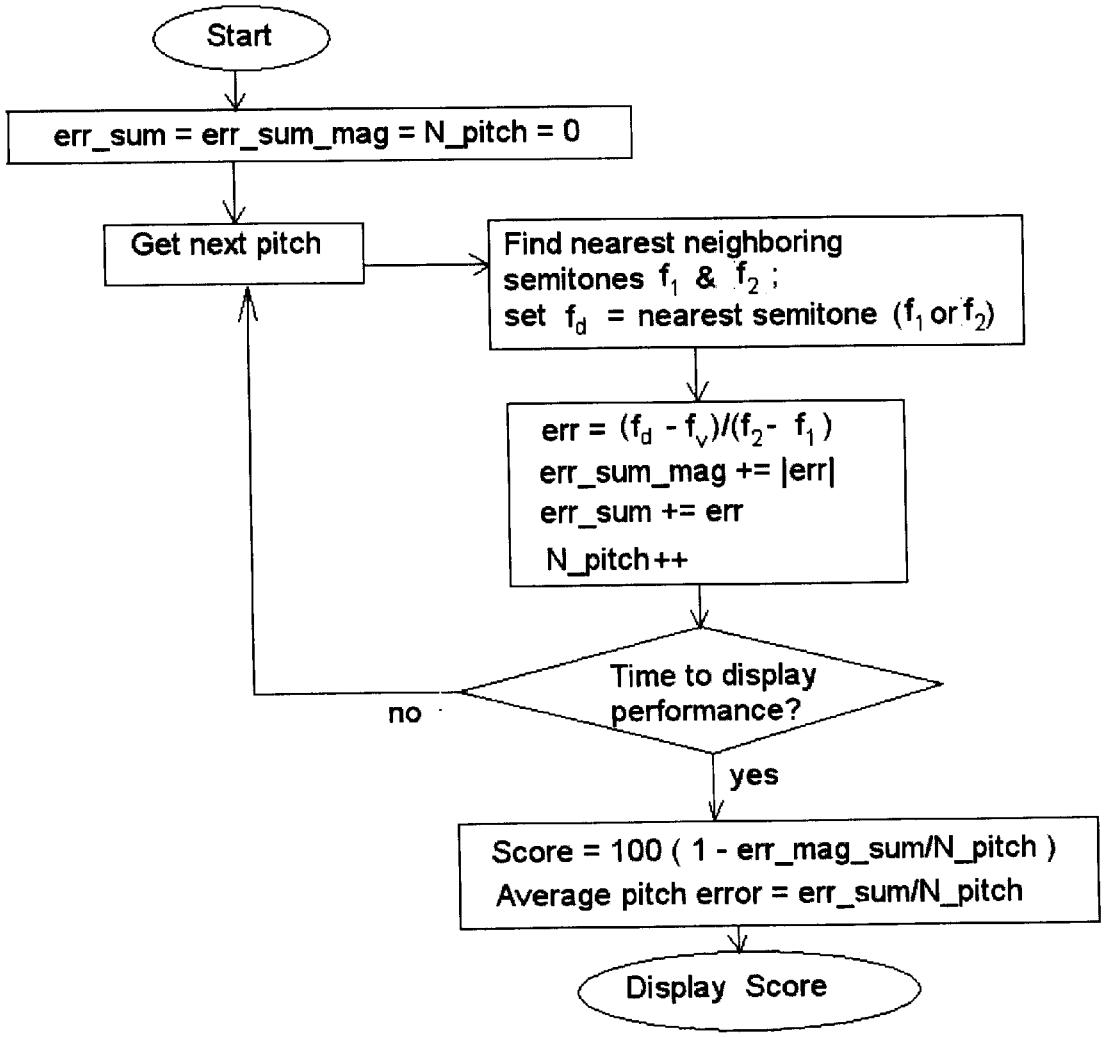
Figure 9:
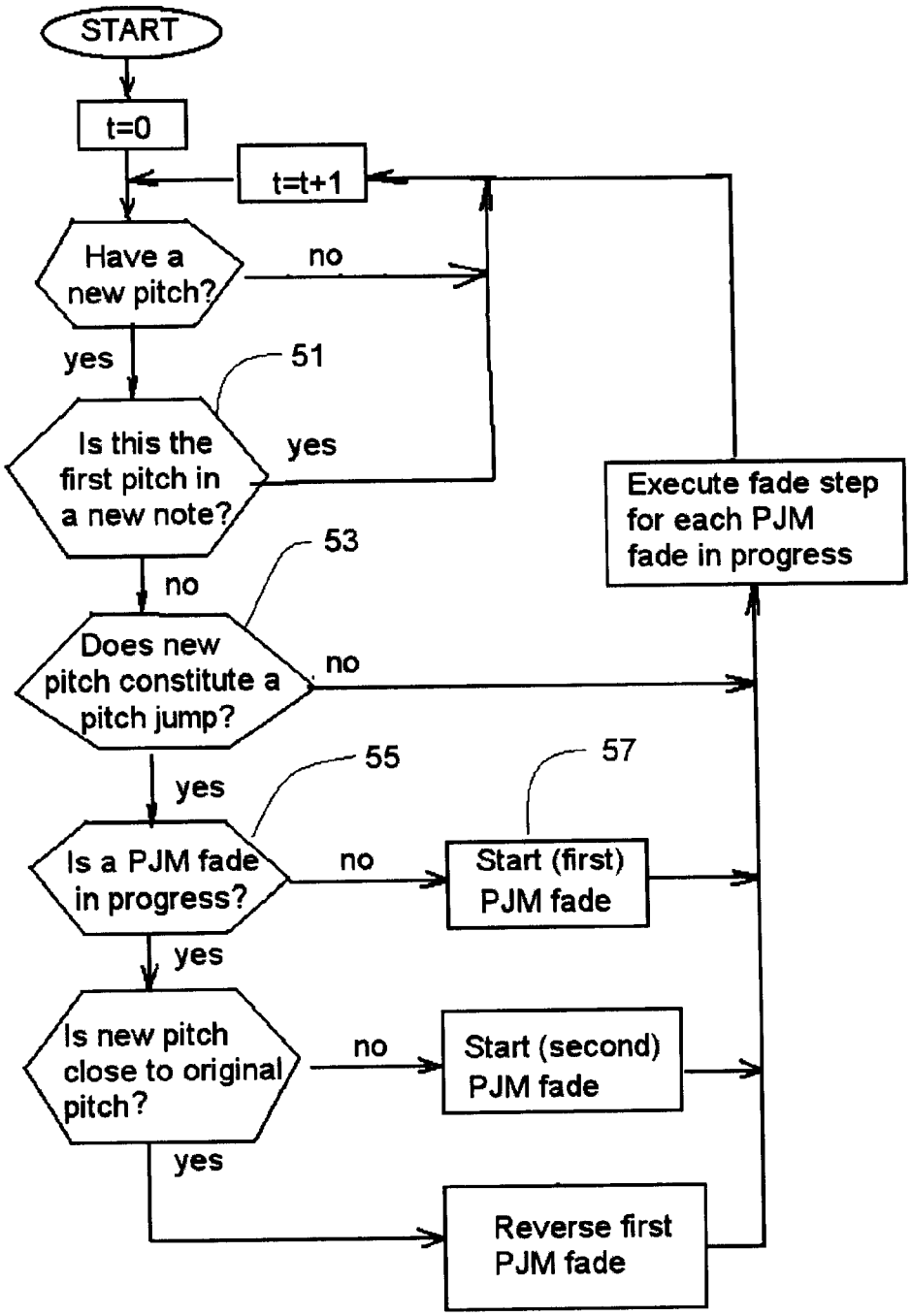
Figure 10:
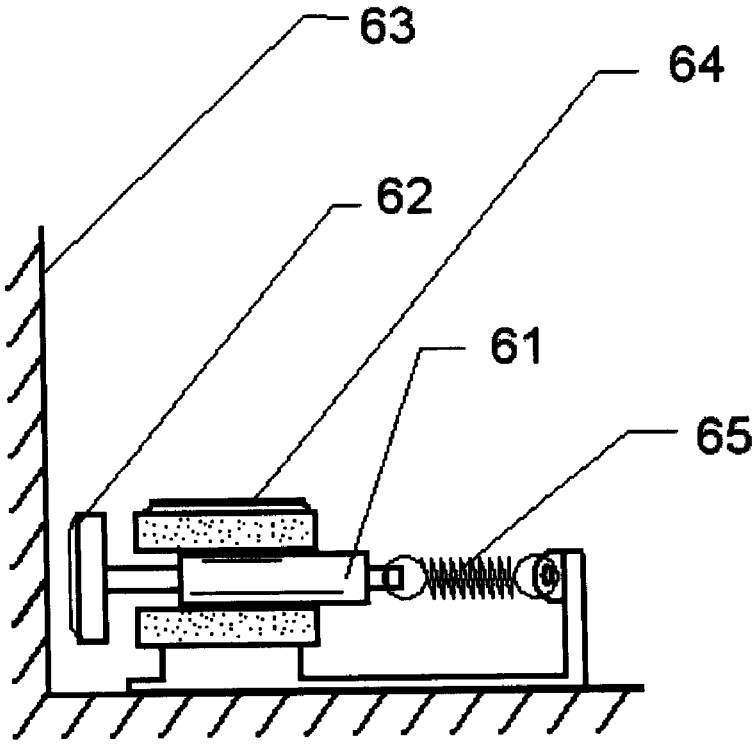
Figure 11:
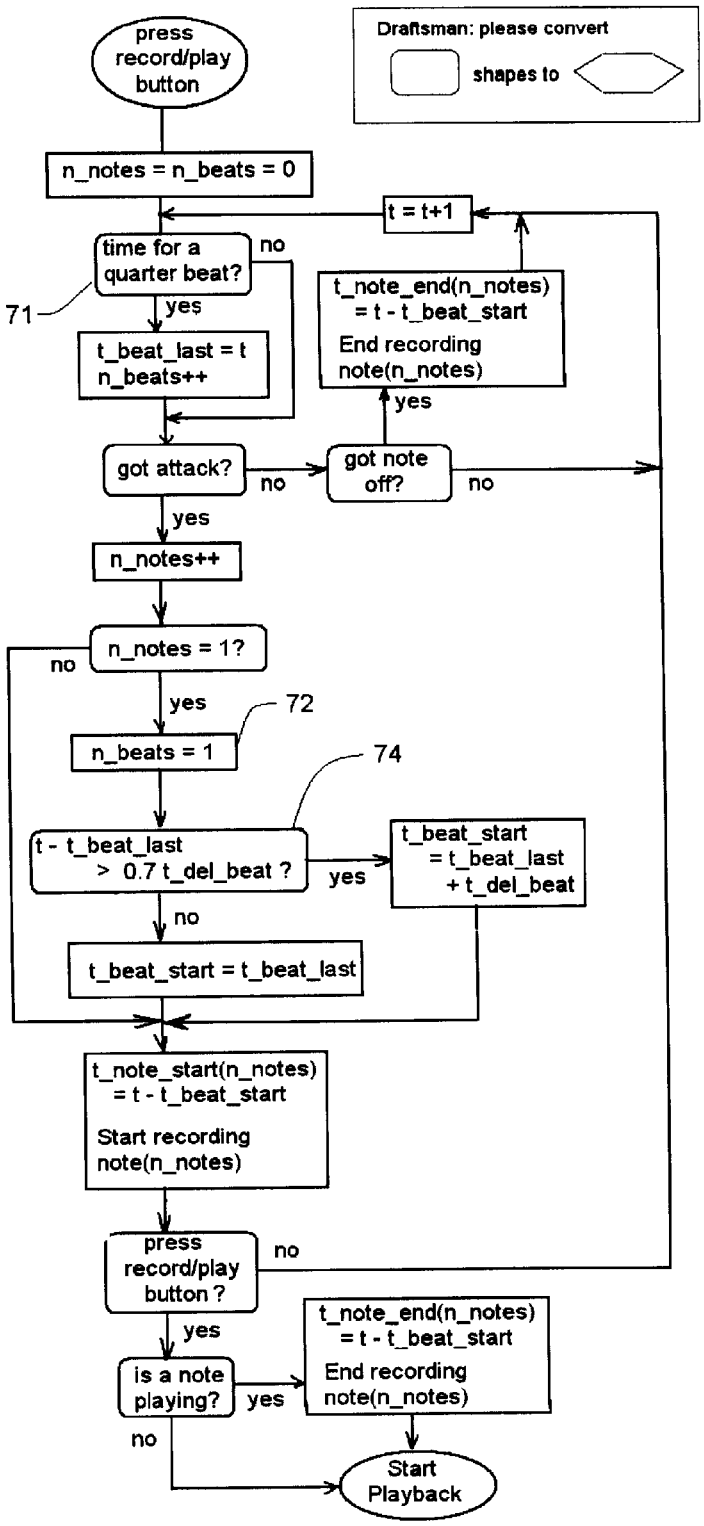
Figure 12:
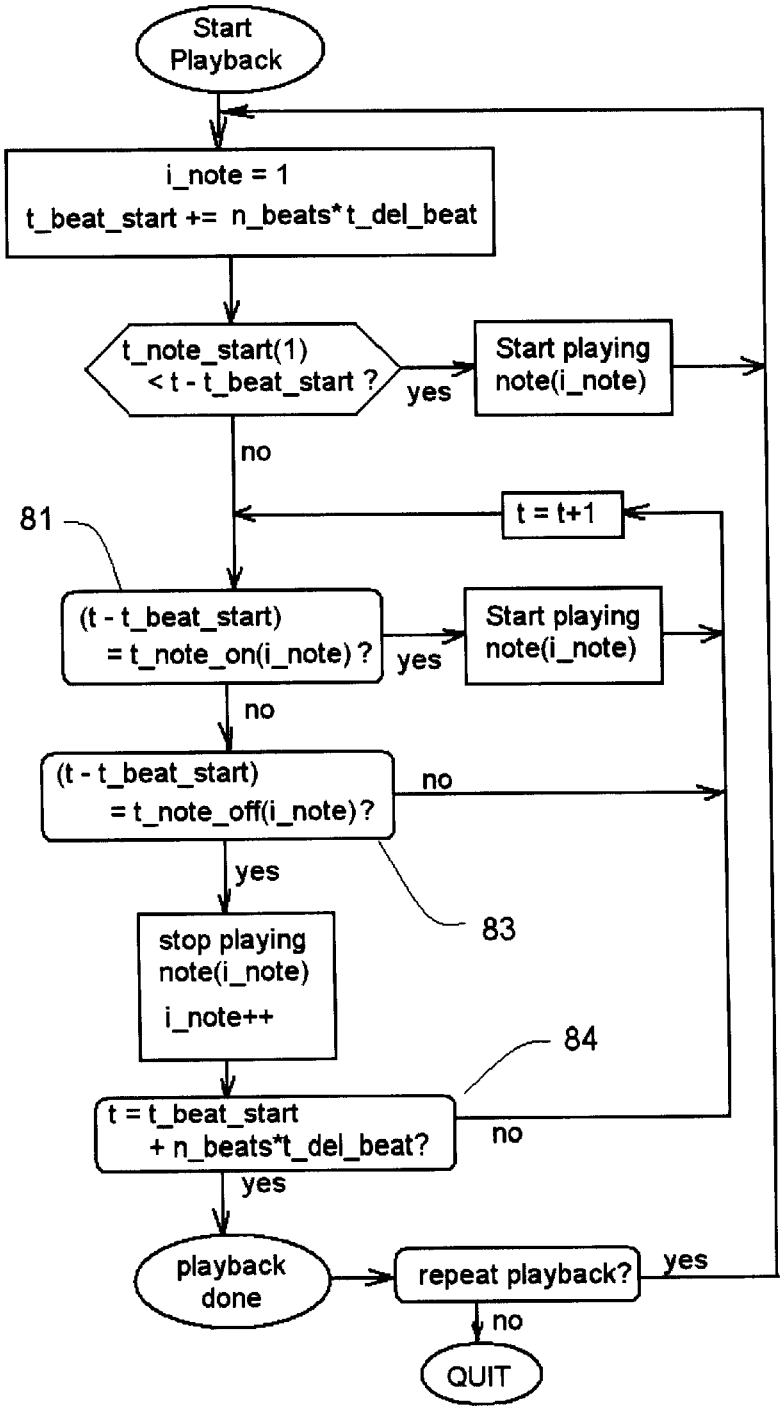
Figure 13A:
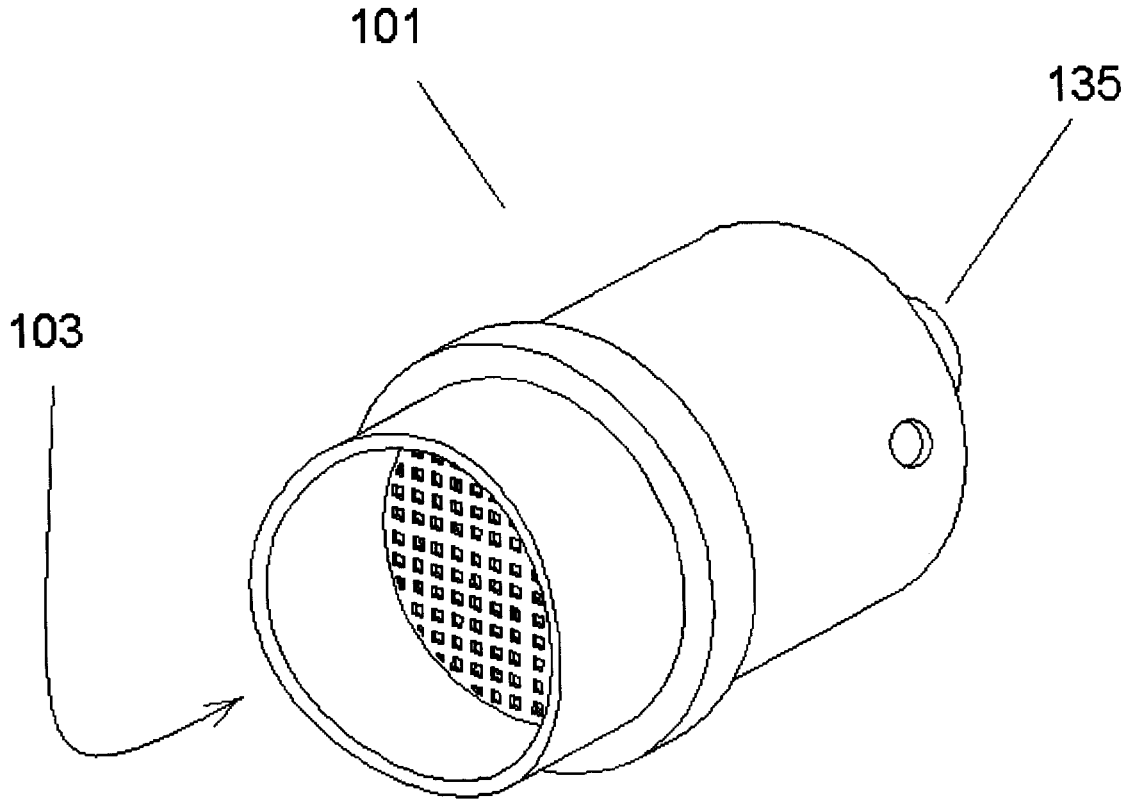
Figure 13B:
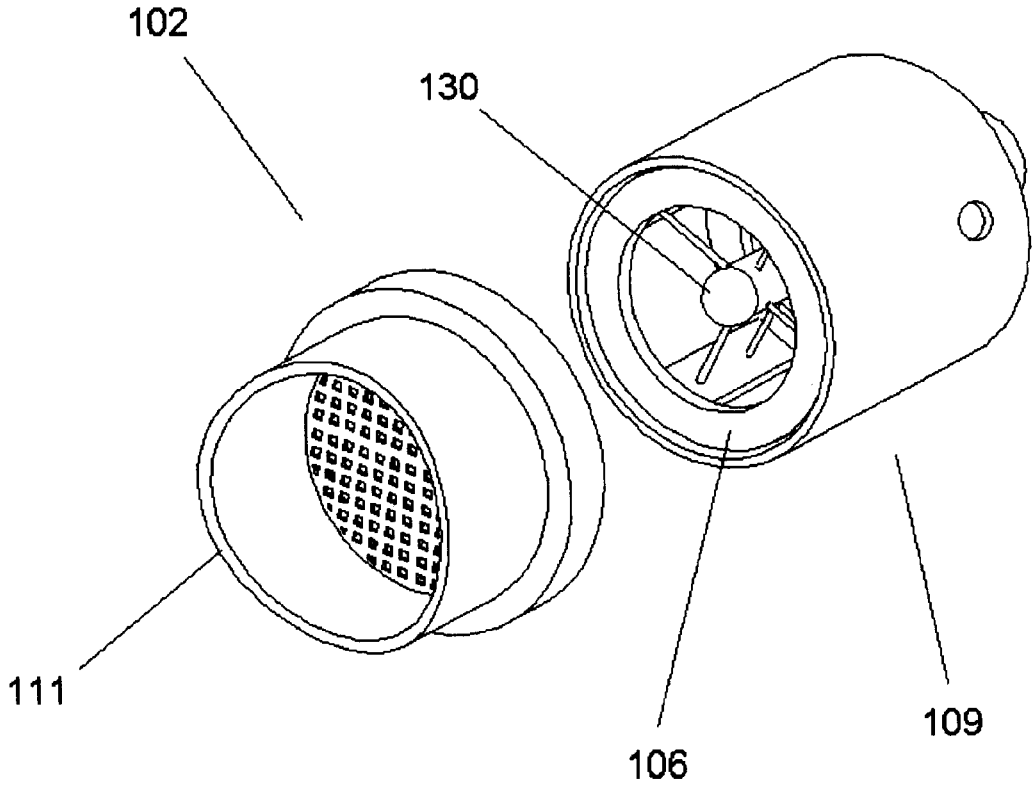
Figure 13C:
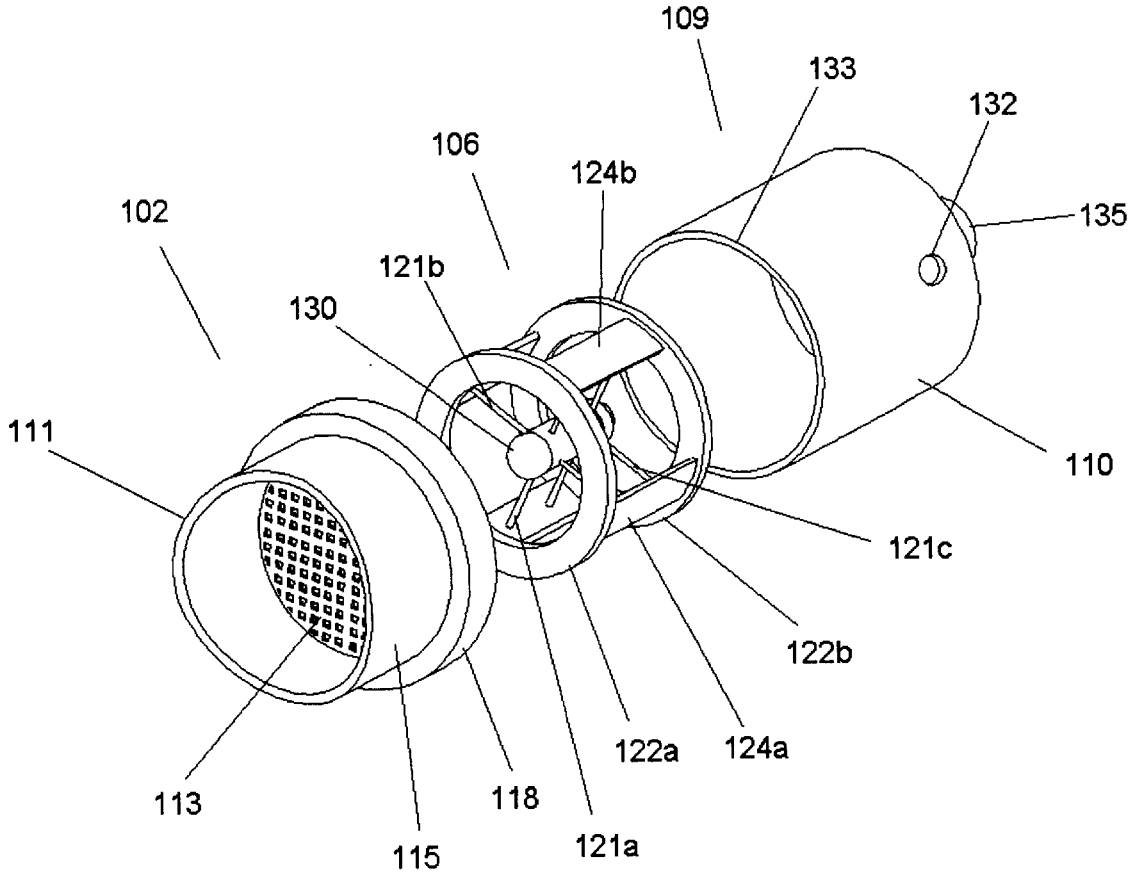
Figure 14A:
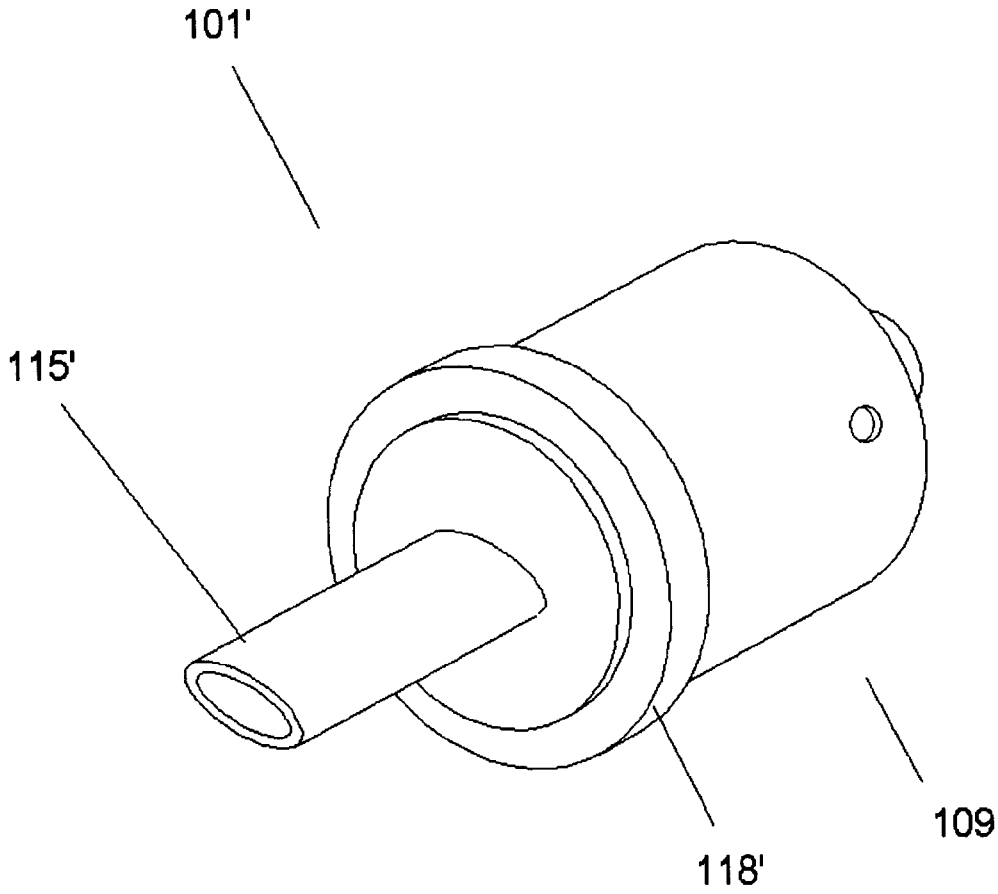
Figure 14B:
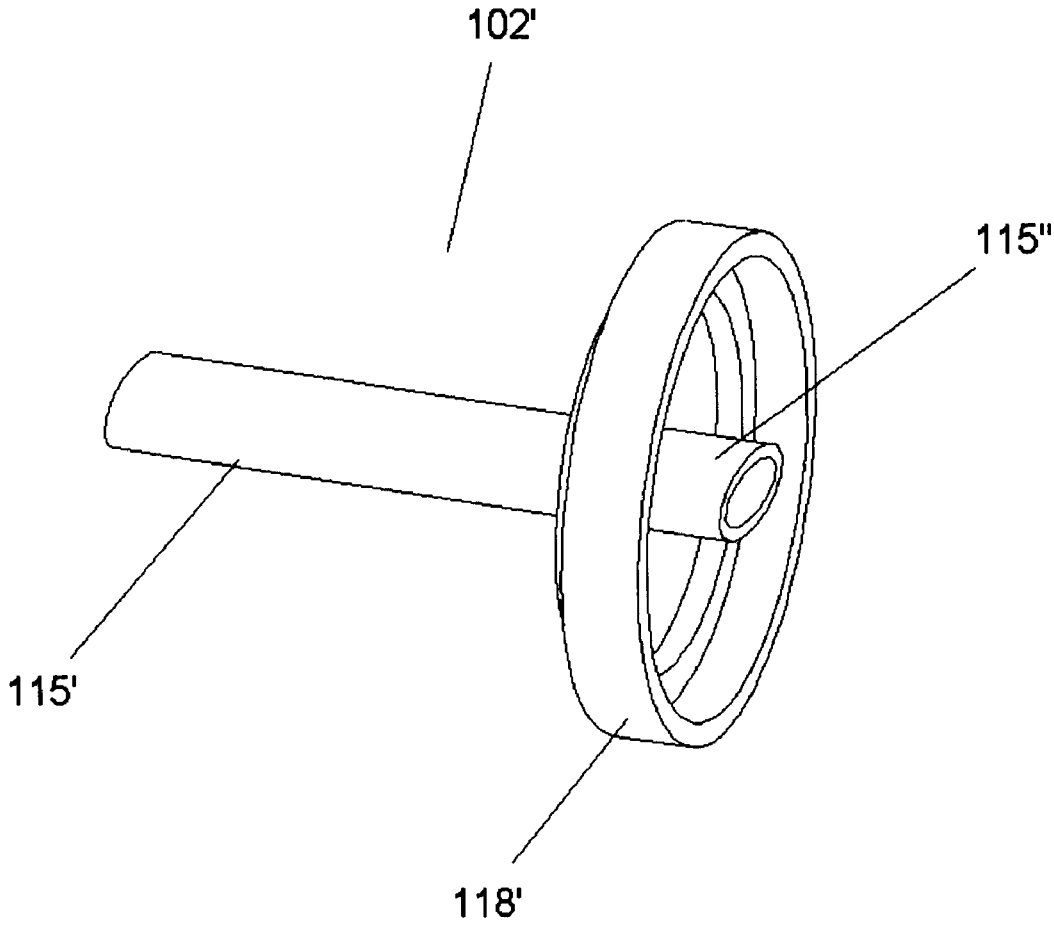
Figure 15:
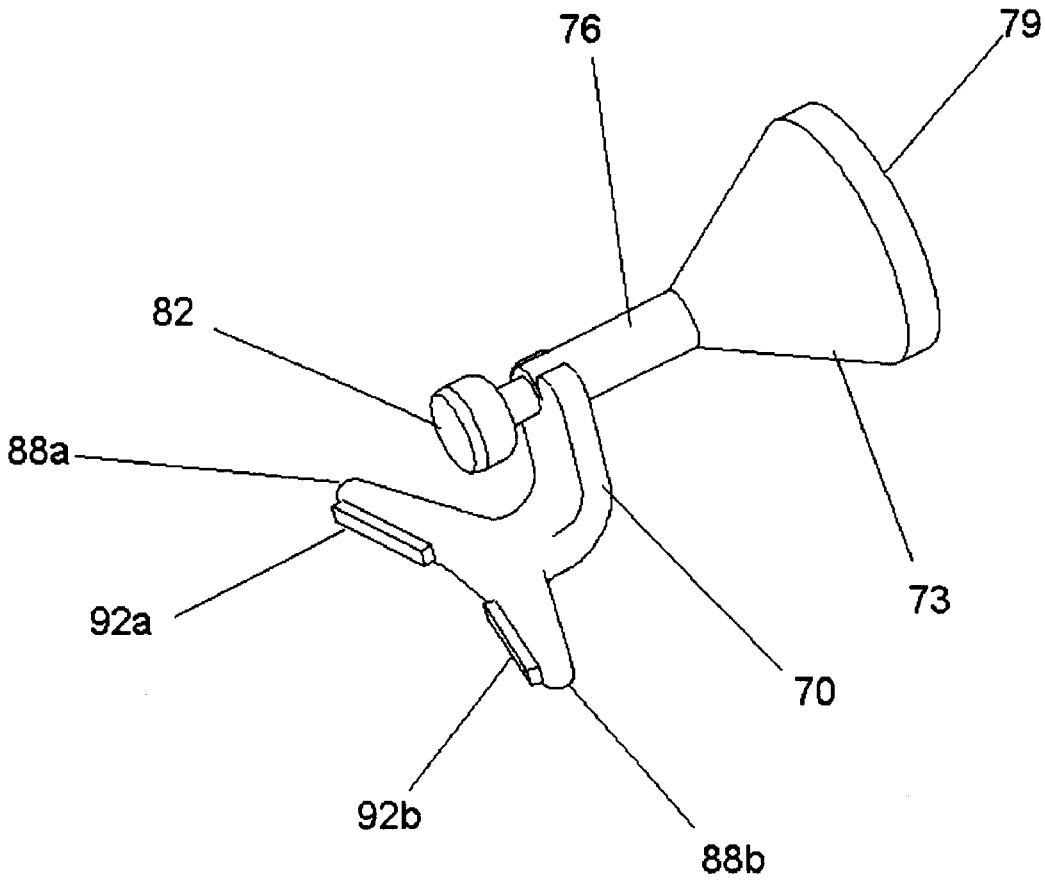
Figure 16:
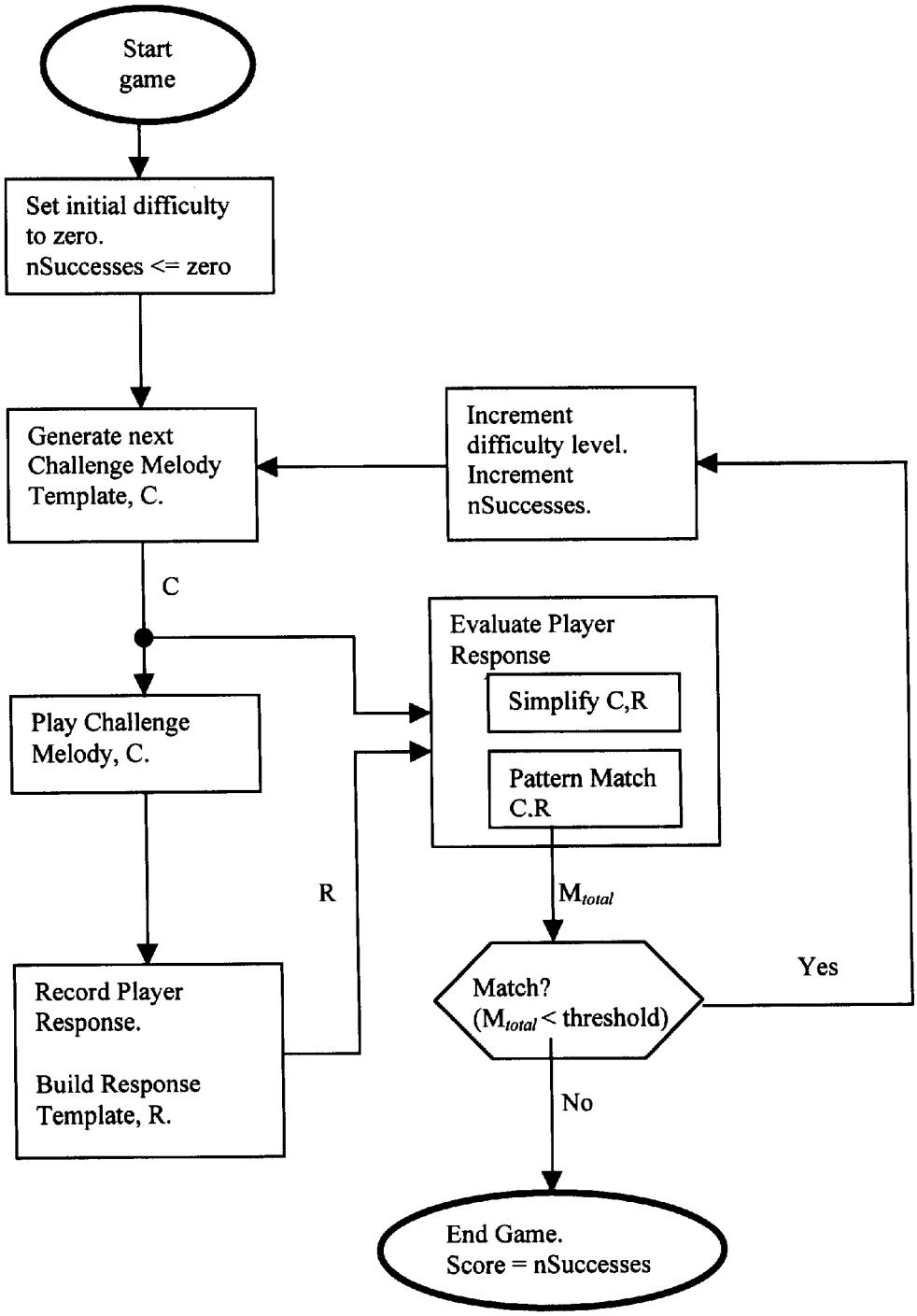
Figure 17A:
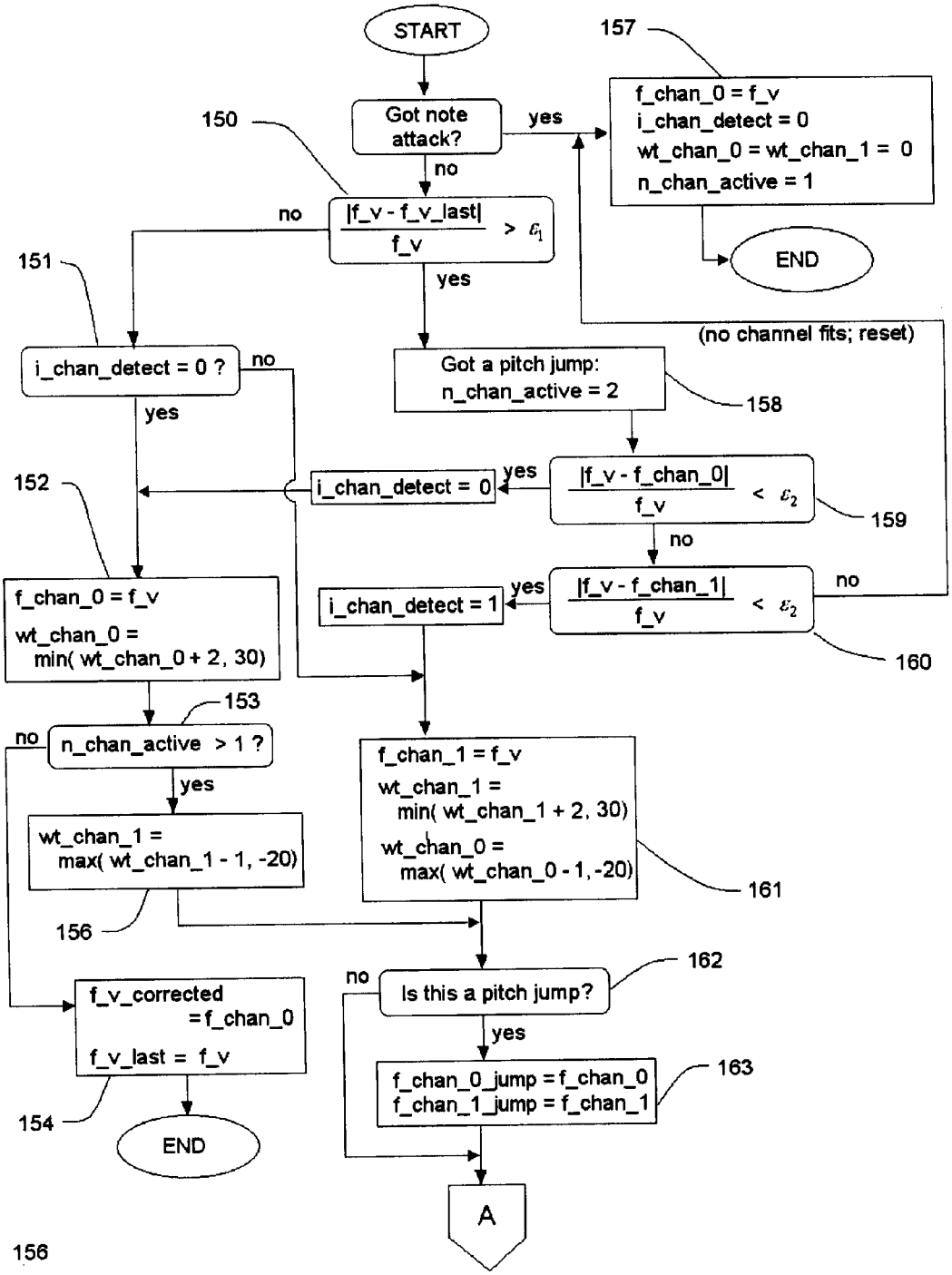
Figure 17B:
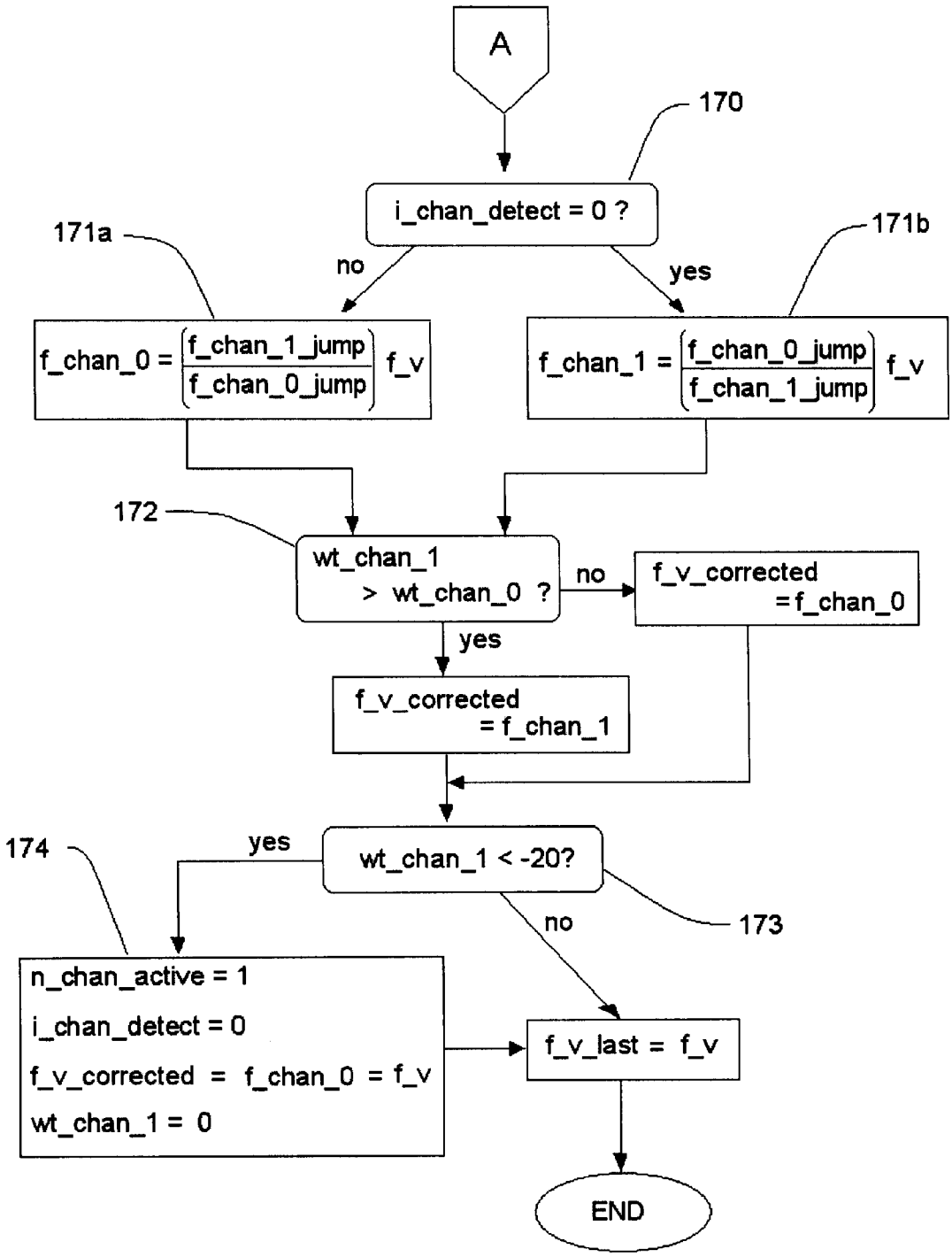

FIG, 5 is a plot of the input frequency versus the output frequency for the discrete pitch mode;

FIG, 6 is a plot of the input frequency versus the output frequency for the semi-discrete pitch mode;

FIG. 7 is a flow diagram for a means for harshness reduction while in the discrete pitch mode;

FIG. 8 is a flowchart of the performance evaluation logic;

FIG. 9 is a flowchart for the logic for mitigating the unpleasantness of a pitch detection error;

FIG. 10 is a schematic representation of the electric drum;

FIG. 11 is a flowchart for the recording sequence logic;

FIG. 12 is a flowchart for the playback sequence logic;

FIGS. 13*a*–13*c* are perspective views of a cup mouthpiece;

FIGS. 14*a* and 14*b* are perspective views of a tube mouthpiece;

FIG. 15 is a perspective view of a chin microphone;

FIG. 16 is a flow chart detailing a logic flow for a "Simon-says" game;

FIG. 17*a* is first part of a flowchart detailing the logic flow for two-channel pitch correction; and FIG. 17*b* is second part of a flowchart detailing the logic flow for two-channel pitch correction.

DETAILED DESCRIPTION OF THE INVENTION

The discussion sets forth the construction and function of the invention, as well as the sequence of steps utilized in the operation of the invention in connection with the illustrated embodiments. It is to be understood by those having skill in the art that the same or equivalents of functionality may be accomplished by various modifications to the illustrated embodiments without departing from the spirit in scope of the invention.

Before setting forth these improvements and new features, however, a brief description of the basic Vocolo is presented first. A more detailed description of the basic Vocolo can be found in the Reference Patent Application.

Figure 1:
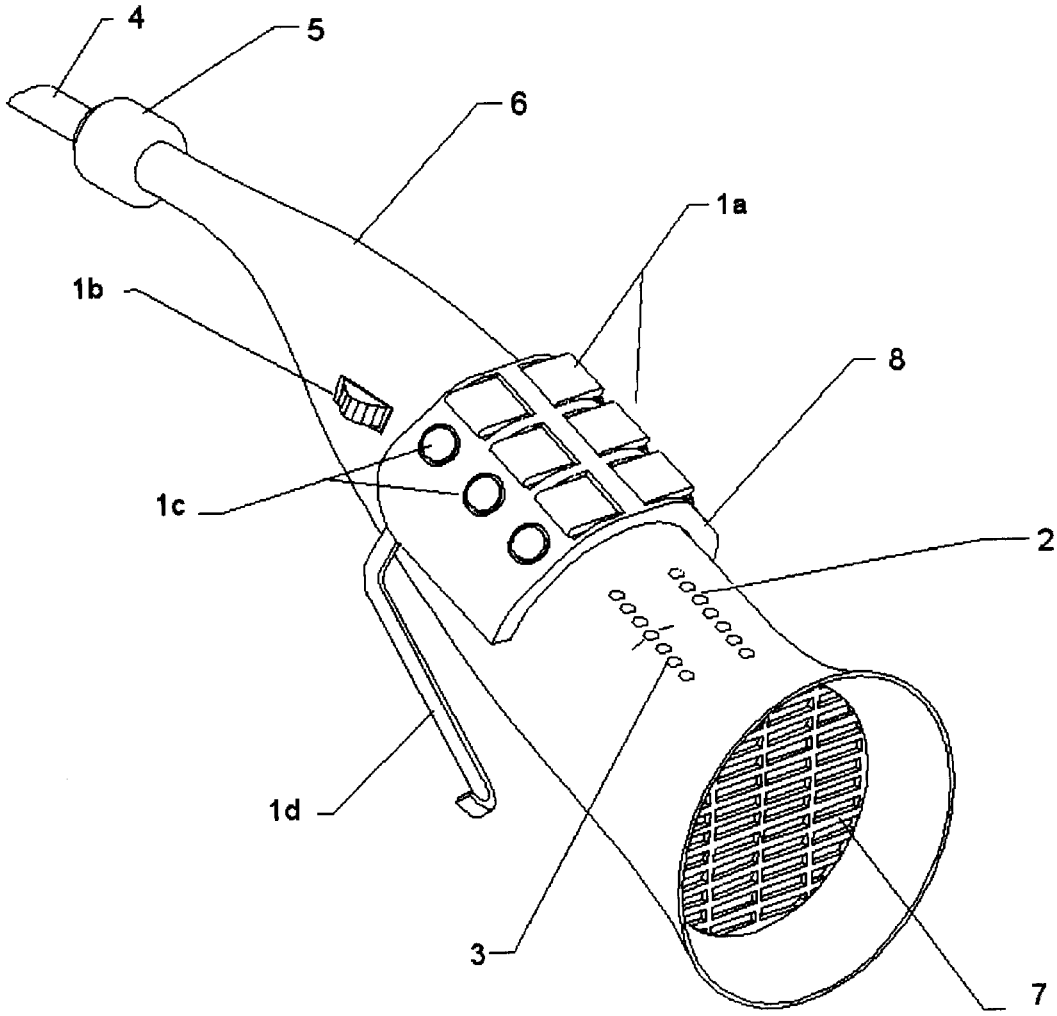
FIG. 1 is a schematic representation of a voice-controlled electronic musical instrument according to the invention.

The Vocolo is a hand-held music synthesizer whose output is controlled by the human voice. FIG. 1 diagrams the functionality of the Vocolo. The player 10 sings or hums into the mouthpiece 14 of the instrument 12. In response, the Vocolo produces the sound at the output 13 of a musical instrument that closely follows in both pitch and volume the nuances of the player's voice. The player can choose which instrument the Vocolo should imitate, and is given the impression of playing the chosen instrument merely by singing.

Figure 2:
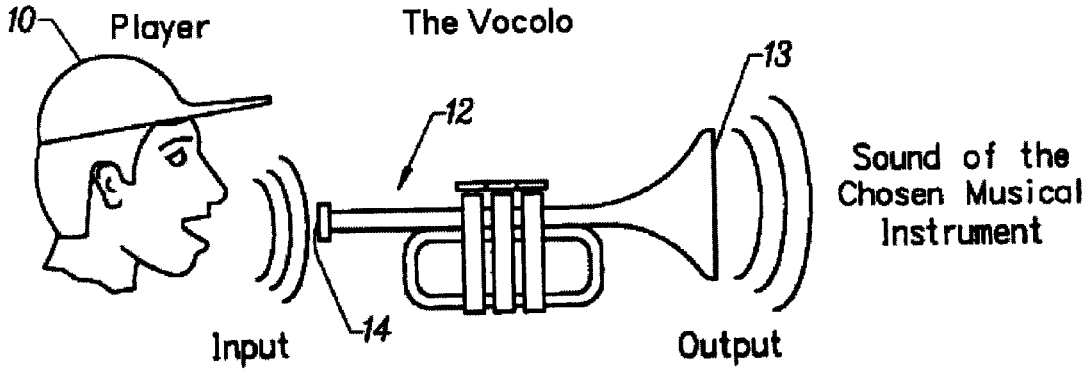
FIG. 2 is a perspective representation of a voice-controlled electronic musical instrument according to the invention.

The Vocolo itself can resemble any known or novel instrument. One possible configuration, which is reminiscent of several well-known instruments, is shown in FIG. 2. In this model, the mouthpiece 5 leads directly to the microphone cup 9. The loudspeaker resides in the housing 11 and the sound is transmitted out of the grill 7. Thus, the housing imparts an acoustic quality to the sound produced. The electronics and batteries are contained in the housing, which also supports several finger-actuated controls: the intermittent buttons 1*a,* the volume control wheel 1*b,* and the modal buttons 1*c*. The intermittent buttons are intended to control performance parameters that vary rapidly during a performance. The modal buttons are intended to alter performance parameters that are expected to stay at some fixed value for an extended period of time, such as instrument selection, volume, or octave. The volume control wheel is intended to control the overall volume of the performance and is intended to be operated by the player's thumb. The wiggle bar 1*d* is intended to be moved by the player's hand (or fingers) for expressive fine control of a selected synthesizer parameter such as volume or pitch. A bank of LED's 3 provides feedback to the player with respect to the sharpness or flatness for a given performance. Similarly, another bank of LED's 4 provides feedback to the player with respect to the pitch accuracy for a given performance.

Figure 3:
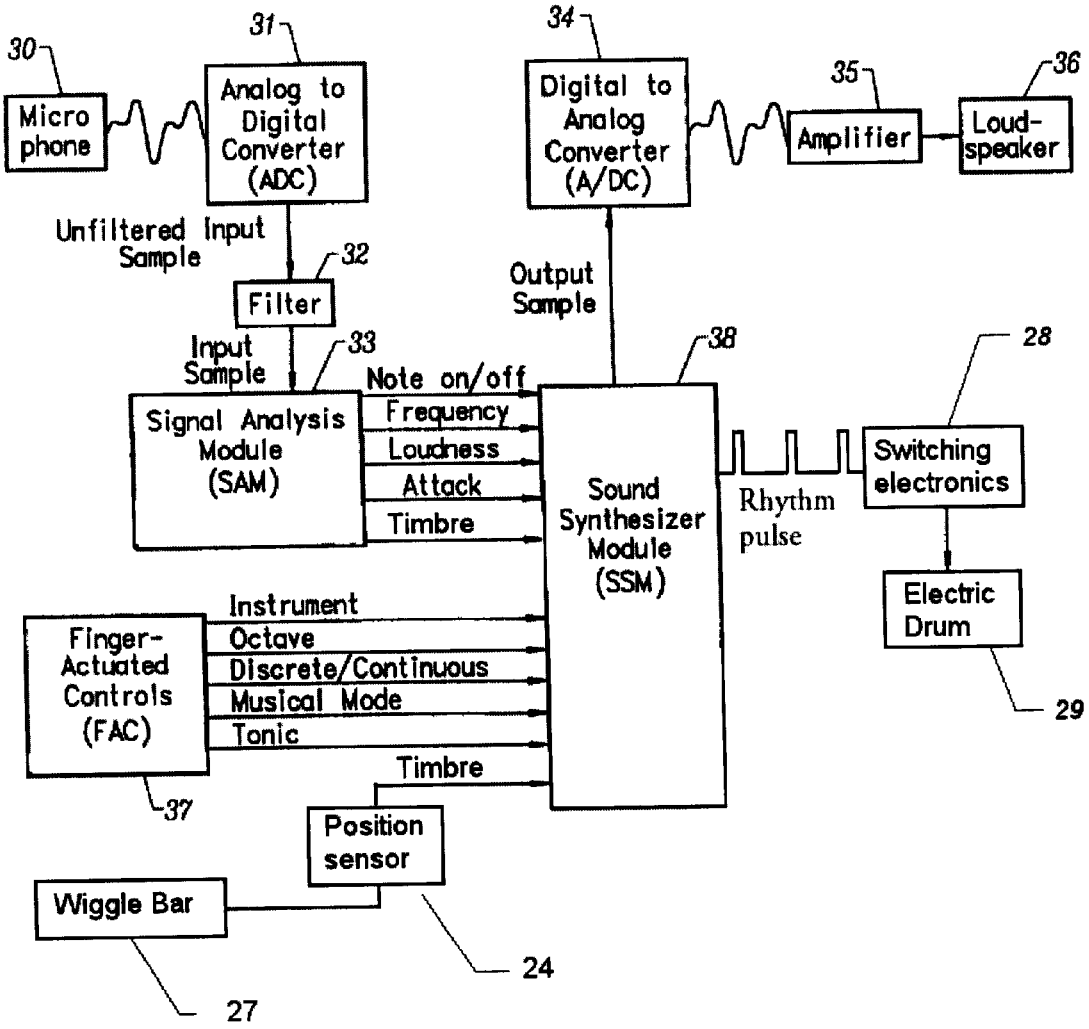
FIG. 3 is a block diagram showing the components of a voice-controlled musical instrument according to the invention.

The logical structure of the Vocolo is diagrammed FIG. 3. The microphone 30 sends an analog signal to an analog-to-digital converter (ADC) 31, which samples the signal at a fixed frequency. The ADC converts one sample at a time and sends it to a band-pass filter 32 (which smoothes the signal by removing frequencies that are too high or too low). Each filtered sample is then sent to the signal-analysis module (SAM) 33 where it is analyzed within the context of the preceding samples. After analyzing the sample, the SAM passes the following information to the synthesizer 38:

- Whether the synthesizer should be playing a note or not, and if so:
- The current frequency,
- The current volume (loudness); and
- Whether the conditions for a new note attack have been detected; and
- The degree and type of timbre.

Besides this information from the SAM, the synthesizer also receives input from the finger-actuated controls 37 and the position sensor 24. The latter measures the position of the wiggle bar 27. These control values can modify a variety of synthesizer parameters, including (but not limited to):

- The current instrument (sound source) to imitate;
- Whether the synthesizer should always play the exact frequency detected by the SAM (continuous pitch tracking) or instead play the nearest note to that frequency in a specified musical mode (discrete or semi-discrete pitch tracking);
- The musical mode to use for discrete or semi-discrete pitch tracking, e.g. chromatic, major, minor, blues;
- Whether the current pitch is the tonic (first note) in the given musical mode;
- Whether to start recording a sequence of notes and when to played back the sequence;

The tuning of the discrete pitches Vocolo for semi-discrete pitch mode;

Whether to invoke evaluation of the performance;

What type of expression the expressive control is to control; and

Expression through an expressive control (e.g., the wiggle bar).

An output sample is then produced by the synthesizer according to all information passed in, and this output sample is fed to a digital-to-analog converter (DAC) 34. The DAC produces an analog output signal from a stream of digital output samples that it receives. This signal is sent to an amplifier 35 before being transmitted by the loudspeaker 36.

The synthesizer also produces discrete logic pulses, according to a desired background rhythm, which are fed into an electronic switch 28, which in turn drives an "electric drum" 29.

The remainder of this document provides a detailed discussion of the components outlined above.

Incremental Autocorrelation for Pitch Detection

Autocorrelation is probably the most popular method used commercially today for pitch detection. This section sets forth improvements for the standard auto-correlation approach used for pitch detection, as well as a hybrid method which is a cross between our preferred peak-based method and the standard approach. To assist in distinguishing the different methods, the following acronyms are defined:

PBAC: Peak-based Autocorrelation, which is the method described in the Reference Patent Application document.

SBAC: Sample-based Autocorrelation, also referred to as standard (incremental) autocorrelation; described in this section.

ISBAC: Interpolated Sample-based Autocorrelation, also referred to as standard (incremental) autocorrelation" this is method set forth in this section.

PASBAC: Peak-Augmented Sample-based Autocorrelation; this is set forth in this section.

A good description of SBAC is provided in the cited patents by Hildebrand and Dame, and is presently reviewed. While the present description does not precisely match theirs, it does convey the central ideas. The non-normalized autocorrelation function for SBAC is:

$$H(t, L) = \sum_{j=0}^{L} S(t-j)S(t-j-L) \tag{1}$$

where t is the current time (referring to the current sound sample), 'L' is the lag, (t−j) is the jth sample in the past, and S(k) is the sound sample at time k (note that the present definition of lag is a little different than that typically used in the literature). H( ) is a similarity measure between two contiguous sound waves, the wave between t−2L and t−L and the wave between t−L and t. These said two waves are presently referred to as the first and second comparison waves, respectively. Generally, the more similar the shape of these two waves are, the higher the value of H( ). However, it is rather simple to normalize the sound waves such that the effect of volume modulation is mitigated. An amplitude-normalized autocorrelation version Z(t,L) of Equation 1 is (see Y. Medan, E. Yari, D. Chazan, *Super Resolution Pitch Determination of Speech Signals,* IEEE transaction on ASSP (October 1989)]):

$$Z(t, L) = \frac{H(t, L)}{\sqrt{E(t-2L, t-L)E(t-L, t)}} \tag{2}$$

$$E(t_1, t_2) = \sum_{t=t_1}^{t_2} [S(t)]^2 \tag{3}$$

where

The fundamental period corresponds to the first local maximum of Z(L,t) with respect to the lag L with the additional condition that Z(L,y)>(1−ø), where ø is a small positive constant (<<1) established a priori. Other forms of normalization are possible as well. In the following Z( ) is used to represent an autocorrelation function which has been normalized and some manner, not necessarily according to equation to (or example, and the reference patent a slightly different form of normalization is prescribed preferred).

Z(t,L) according to Equations 1 and 3 can be extremely expensive to compute. This approach is presently called a sample-based auto-correlation (SBAC) because Z( ) must be computed at each time step, i.e. for each sample coming in or, if down-sampling is applied, e.g. every fifth sample. Peak-based auto-correlation, on the other hand, only computes Z( ) every time a strong peak in the filtered sound wave is encountered; this tends to be about every five milliseconds or so (and contains other expediencies as well).

Two primary methods have been employed in the literature to reduce the computation rate (employed by both Dame and Hildebrand). The first has been to calculate the auto-correlation function recursively, taking advantage of the fact that Z(t,L) depends only on Z(t−1,L) plus a few more terms. The second has been to use a dual resolution computation of Z(t−1,L), using a down-sampled, or low-resolution form of the sound wave to get a coarse estimate of the optimal lag (L*), and then a high resolution search for the best lag near the solution found by the low resolution search (L**). For example, the original, the down-sampled, and high-resolution rates could be 24,000 hz, 8,000 hz, and 24,000 hz respectively.

Regarding notation in the following descriptions, in general S(t) is the sound signal at time t, and $\underline{S}_a$ and $\underline{S}_b$ refer to two contiguous segments of S(t) to be compared to see if they match. If the periods of $\underline{S}_a$ and $\underline{S}_b$ are assumed to be equal, then $\underline{S}_a$ refers to the vector $[S(t), \ldots, S(t-L)]^T$ and $\underline{S}_b$ refers to the vector $[S(t-L), \ldots, S(t-2L)]^T$. If $\underline{S}_a$ and $\underline{S}_b$ are bounded by peaks (as in PBAC) then the periods are not assumed to be equal, and $\underline{S}_a$ refers to the vector $[S(t), \ldots, S(t_{split})]^T$ and $\underline{S}_b$ refers to the vector $[S(t_{split}), \ldots, S(t_{start})]^T$.

ISBAC: Improving SBAC using Interpolation

As mentioned above, the second stage for the dual-resolution searches of the Dame and Hildebrand methods finds the autocorrelation for each lag at the original (high) sample rate for a small set of lags surrounding the L* found from the down-sampled autocorrelation function.

The herein disclosed method based on interpolation is similar to the SBAC method just described in that the auto-correlation function is calculated initially on the down-sampled sound data using the recursive formulation. However, a different approach is used to calculate the high-resolution lag value from the low-resolution lag value, i.e. instead of using a said high-resolution search. If L* is the value of the optimum lag for the down-sample signal at time t, then Z(t,L*−1) and Z(t,L*+1) are both less than Z(t,L*). A parabola can be fit to these three points, i.e.

$$Z'(t,L)=a+bL+cL^2 \tag{4}$$

where a, b, and c are the (quadratic) coefficients to be determined from the data, and H'( )is the best fit estimate of L in the region of L*. Utilizing the Z(t,L*−1), Z(t,L*) and Z(t,L*+1) values with Equation 4 provides three linear equations and three unknowns to compute the coefficients. The optimum lag L lies at the peak (or valley) of the quadratic, i.e. at L=b/(2c). This method for computing the high-resolution lag is much more computationally efficient than employing the high-resolution search described above.

PASBAC: Improving SBAC using Peak Information

In this embodiment, the coarse estimate of the period L* is still employed using (recursively computed) SBAC on (band pass filtered) down-sampled data. However, instead of resorting to a high-resolution search for the best lag at this point, the fine fundamental period is found by searching the most recent peaks in the sound wave. That is, assuming that we are at time t, which may or may not correspond to a peak, we wish to find two strong peaks in the most recent past which has an interval between them most closely matching L*. A strong peak is presently defined as a peak that is very unlikely not to have a counterpart one fundamental wavelength in the past and can be defined, e.g. according to the criteria:

$$t_{peak}=i \tag{5a}$$

such that $$sgn(S(i)-S(i-1))\neq sgn(S(i+1)-S(i)) \tag{5b}$$

and $$|S(i)-S(i-1)-(S(i+1)-S(i))|>\epsilon \tag{5c}$$

where sgn( ) refers to the sign of the corresponding expression, and is a predefined constant (the higher the constant the stronger the peak). Now define $t_{MRP}$ as the most recent (strong) peak to the current time t, and $t_{LP}(k)$ as the time of the lag peak, i.e. the strong peak before $t_{MRP}$ that also minimizes the error function:

$$D(k)=(L^*-t_{MRP}+t_{LP}(k))^2 \tag{6}$$

That is, if k* be the value of the time index k that minimizes the above expression, then the fine resolution estimate of the period is given by:

$$L^{**}=t_{MRP}-t_{LP}(k^*)^2. \tag{7}$$

To review, as the sound data comes in at the high sample rate, e.g. 24,000 hz, the times for the recent strong peaks are kept in a (circular) buffer. This sound data is also down-sampled, e.g. to 8,000 hz, and the (recursive) SBAC method is used to find L* using this data, e.g. as per Dame. Once L* is found, the minimum D(k) is found with respect to k using Equation 6 (k* corresponds to this minimum). Finally, L** is computed from Equation 7 using this value of k*.

Computing the fine resolution period in this fashion is much less computationally expensive than using the fine resolution method described in the last subsection.

While the above modifications of standard autocorrelation (ISBAC and PSBAC) provide for more efficient computation than SBAC, the most preferred approach is still PBAC, or peak-based autocorrelation, because it is the most computationally efficient by a good margin. However, it is conceivable that ISBAC or PSBAC may be preferred over PBAC in certain circumstances, e.g. where the processor RAM or the program ROM is very small (PBAC requires a little more RAM and a little more program space).

Pitch Smoothing

Figure 4:
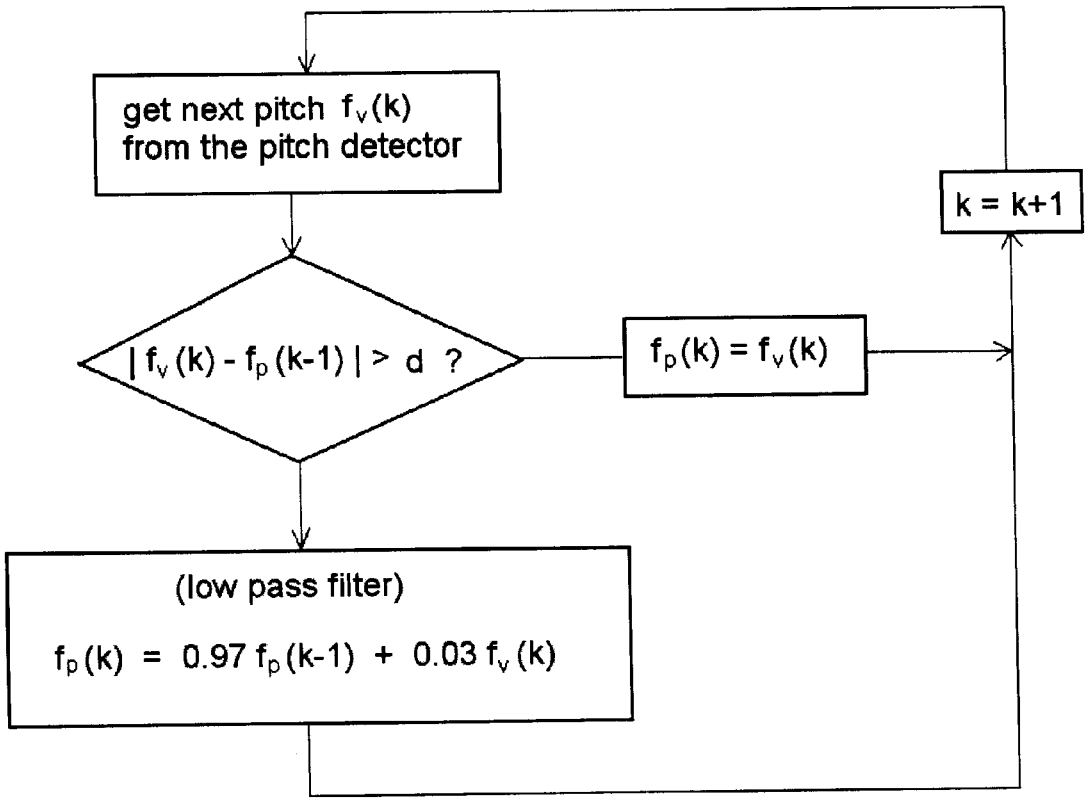
FIG. 4 is a flowchart detailing the method for pitch smoothing.

The Vocolo converts the singer's voice into an instrument sound of the same fundamental pitch as the voice. A waver in the singer's voice, however, can produce a somewhat unpleasant instrument sound (especially for novices). Having the pitch played by the instrument ($f_p$) be a smoothed version of $f_v$ can mitigate this unpleasantness. Hence, it may be desired to use a low pass filter on $f_p$ to obtain $f_v$ FIG. 4 shows a flow chart of this logic, where k indexes the most currently detected pitch $f_p(k)$, and where a very simple type of low pass filter is shown employed (short term averaging). If the tracking error is greater than some threshold then the logic resets $f_p=f_v$, and then invokes the tracker again when the error falls under the threshold. If the pitch is lost by the pitch detector, the logic resets $f_p=f_v$ when the pitch is re-established. Note that this algorithm becomes part of the Signal Analysis Module (SAM) 33 (see the Reference Patent Application for more details on the SAM), but now the frequency passed to the Sound Synthesizer Module 38 is $f_p(k)$.

Another advantage of using pitch smoothing arises if the sample rate is low relative to the expected fundamental period range of the player. In such a case, for example, there may only be ten or twelve samples over a fundamental period. This often results in computed pitch values that oscillate significantly about their true values (producing an unpleasant instrument sound). Hence, a smoothing method as set forth here produces a pitch output which averages out the oscillation and approaches the true value more closely, and produces a much more pleasant instrument sound.

It is to be understood that any kind of low-pass filter can be used in the present pitch smoothing algorithm without deviating from the spirit of the present approach.

The Semi-discrete Pitch Mode

Figure 5:
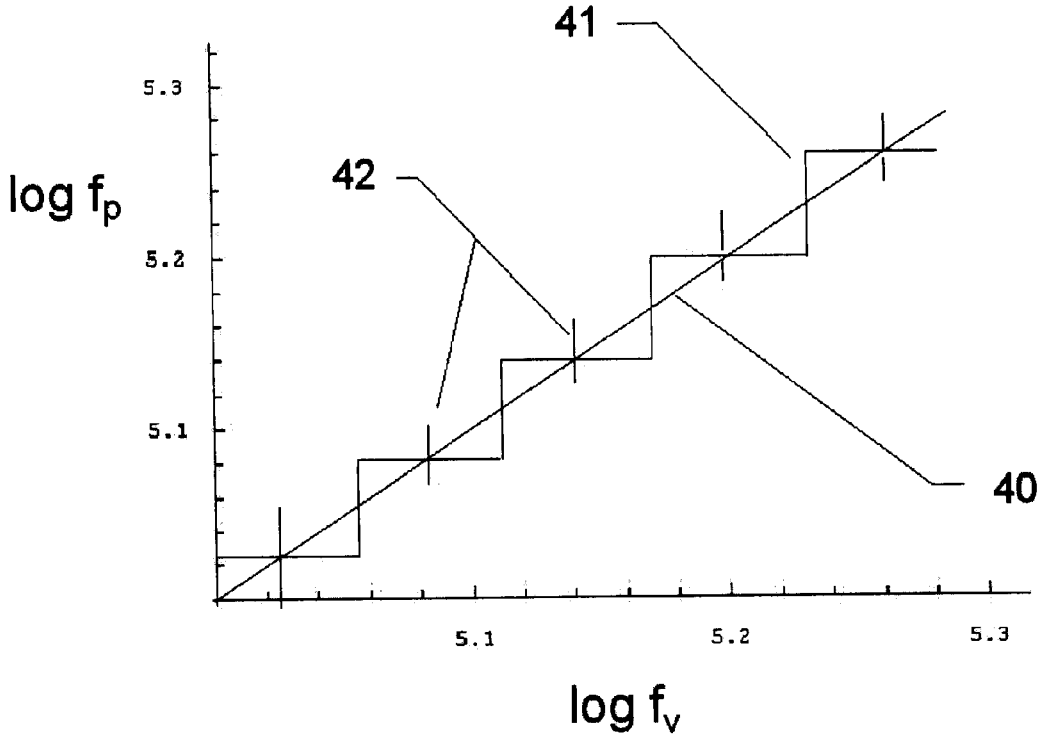

There were two modes of pitch control in the Reference Patent Application, the continuous pitch mode and the discrete pitch mode (these types of methods are often referred to as pitch quantization methods in the literature). The preferred embodiment, called the semi-discrete pitch mode, is a hybrid of the continuous and discrete modes. In continuous pitch mode, the frequency played on the instrument ($f_p$) is the same as that of the person's voice ($f_v$) In discrete pitch mode, $f_v$ is a (multiple) step function of $f_p$. FIG. 5 shows the even staircase 41 that relates $\log(f_p)$ as a function of $\log(f_v)$ for the case where the discrete pitches correspond to natural semitones. The continuous pitch mode corresponds to the diagonal line 40 splitting the staircase function in FIG. 5. The vertical hash marks 42 indicate the $f_v$ locations for the discrete pitches (for example, semitones).

Figure 6:
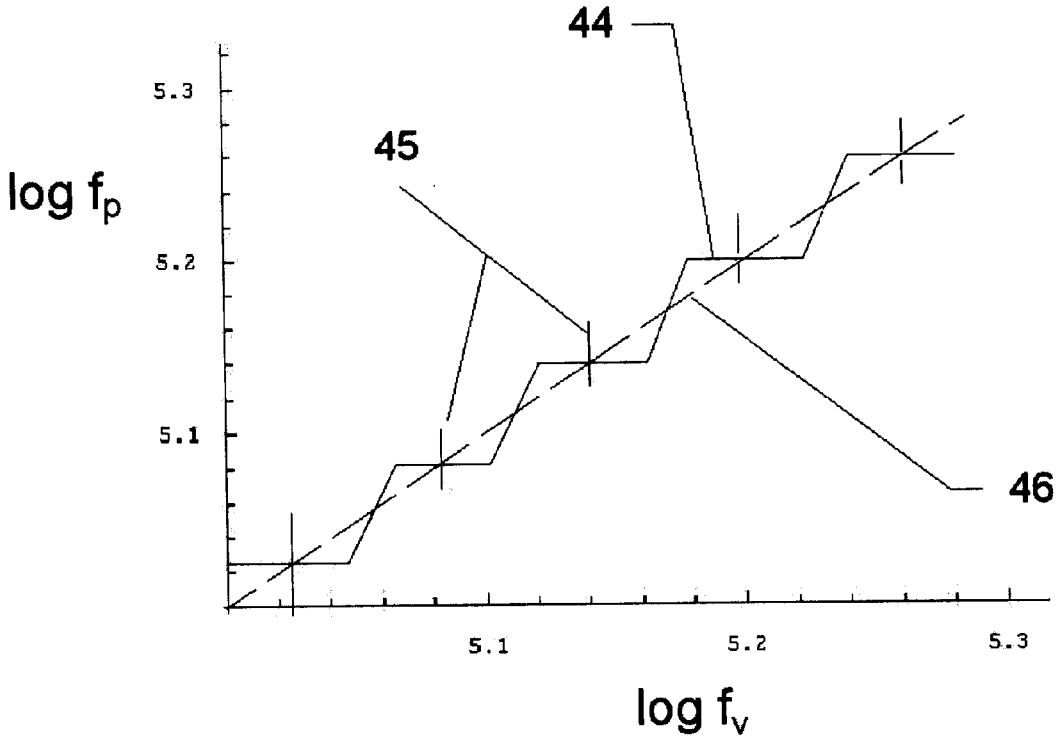

The semi-discrete pitch mode for natural semitones is shown in FIG. 6. This staircase-like function has substantially flat landings 44 centered about semitone locations (indicated by the vertical hash marks 45). The landings may be perfectly flat or at a small angle with respect to the horizontal. Note that to distinguish between the difference pitch modes more clearly the straight staircase of FIG. 5 is henceforth referred to as the purely-discrete pitch mode.

Note that the purely-discrete pitch mode is a special case of the semi-discrete pitch mode.

It is to be understood that the staircase functions described above could be replaced by a relationship between $\log(f_v)$ and $\log(f_p)$ which is smooth in the first derivative ($df_p/df_v$), but does not have to have perfectly flat (or straight) segments. Nevertheless, the basic shape is retained. For example, one interesting version is for the function to have zero slope everywhere except at the precise semitone pitches. In this case the semitones correspond to inflection points in the function.

If computation and/or RAM overhead is to be minimized for a low cost application it may preferable to represent the semi-discrete function with piece-wise linear segments in the ($f_p$, $f_v$) space instead of the ($\log(f_p)$, $\log(f_v)$) space. To calculate $f_p$ from a given $f_v$ for this approach, first the two discrete pitches surrounding $f_v$, $f_1$ and $f_2$, are found by a simple comparison search. Then $f_p$ can be calculated from the equation:

$$\begin{aligned} f_p &= f_1;\ \text{if}\ \left(f_v < \frac{\beta}{200}\right) \\ &= f_2;\ \text{if}\ \left(f_v > f_2 - \frac{\beta}{200}\right);\ \text{otherwise} \\ &= f_1 + \frac{(f_2 - f_1)\left(f_v - f_1 - \frac{\beta}{200}\right)}{f_2 - f_1 - \beta} \end{aligned} \tag{8}$$

where $0<\beta<100$ is the percent of discreteness of the piece-wise linear semi-discrete function ($\beta=0\%$ and $\beta=100\%$ correspond to continuous and purely discrete cases, respectively). The slight disadvantage of this approach is that, when viewed in the log-log plot, the steps are not quite as symmetric as they are for the log-log formulation. However, in most circumstances the difference would likely be imperceptible to any listener.

The semi-discrete pitch mode can be implemented as either part of the SAM or the SSM although it is preferred to implement it with the SAM. Note that if it is implemented in the SAM then, in FIG. 3, the Frequency input to the SSM module is replaced by the output of the semi-discrete function,

Harshness Reduction of Discrete Pitch Mode with Pitch Smoothing

One of the advantages of the semi-discrete pitch mode set forth above is that steady discrete pitches can be achieved while avoiding the rough sound that accompanies a purely-discrete pitch mode (due to be sudden change in pitch for the staircase function). Another method for avoiding the rough sound is to employ the pitch smoothing method described above in combination with the purely-discrete pitch mode.

In particular, let $f_p'$ be the pitch output by the purely-discrete pitch mode as a function of the voice pitch $f_v$, i.e. $f_p'$ replaces $f_p$ in the staircase function in FIG. 5. Now, instead of having the instrument play $f_p'$, use $f_p'$ as the input to the pitch smoother instead of $f_v$ (in FIG. 4), and the output of the pitch smoother is $f_p$, as shown in FIG. 7. The pitch $f_p$ is the pitch to be played by the instrument and now incorporates pitch smoothing on top of the purely-discrete pitch mode. This present approach is called the smoothed-discrete pitch mode.

For the smoothed-discrete pitch mode it is required to set the value of the threshold 'd' (see FIG. 4) somewhat larger than that needed for the original application of smoothing (described in the previous section). This is because it is not desired to reset $f_p'=f_v$ during the pitch jumps of the purely-discrete pitch function. In particular, it is preferred to set the threshold as a small factional percent of $f_v$, i.e. to use the reset logic $|f_v(k)-f_{p'}(k)|<ef_v$, where 'e' is a small constant.

The semi-discrete pitch mode is presently generally preferred over the smoothed-discrete pitch mode because of its greater predictability (and thus controllability). However, there may be instances where the smoothed-discrete pitch mode is preferred. One main difference between these two modes is that the pitch output by smoothed-discrete pitch mode ($f_p$) depends on the rate of change of the input pitch, whereas the semi-discrete pitch mode does not have this dependency. For example, if this rate of change of the input pitch is very low, the output of the smoothed-discrete pitch mode approaches that of the purely-discrete pitch mode.

Tuning the Vocolo with Semi-discrete Mode

In the any of the discrete pitch modes described herein it is desirable to provide the ability to adjust the vertical location of the substantially flat landings (44 in FIG. 6). This allows for the tuning of the Vocolo to match that of an external recording or accompaniment. Note that this process is independent of the pitch of the player's voice.

To change in the tuning of the Vocolo, the staircase function is to be translated along the diagonal line connecting the center of its substantially flat landings (46 in FIG. 6 or 40 in FIG. 5). Put another way, let $f_i$ be the $i^{th}$ discrete pitch for the semi discrete pitch matching function. To tune the Vocolo sharper by a given percentage (z), each $f_i$ is redefined as $$F_i(\text{sharper})=f_1(\text{original})*(1+z/100) \tag{9}$$

A mechanism must be provided for manual adjustment of the Vocolo tuning. The least expensive approach is to use a pair of the modal buttons (1*c*) in FIG. 2, wherein pressing one of the pair of buttons tunes the Vocolo slightly sharper (e.g., 0.05% or z=0.05) and pressing the other tunes it slightly flatter.

Pitch Performance Evaluation

Following is a description of a Pitch Performance Evaluation Module (PPEM), which is an optional feature for the Vocolo system. The purpose of the PPEM is to measure how well the player hits the semitones during a performance. The input to the PPEM is the player's pitch and attack information (as detected by the SAM), and the output is an indication of the average pitch error. The goal of the player is to minimize this average pitch error. It is also desirable for the PPEM to keep track of and display the average pitch error magnitude because it is possible, in principle, to have a zero average pitch error for a very poor performance because the pitch errors could cancel each other out. The average pitch error magnitude can be seen as the badness of the performance (for the sake of seeing the glass half full it is probably better to display the inverse of the badness, that is, the goodness the performance instead). The average pitch error, on the other hand, is more of a guide to tell the player how he should be correcting his voice.

FIG. 8 shows a logic diagram for pitch performance evaluation. Each time a pitch ($f_v$) is detected by the SAM, the nearest semitones $f_1$ and $f_2$ on either side of $f_v$ are first found through a simple comparison search (such that $f_1<f_v<f_2$). Then the variable $f_d$ is set equal to either $f_1$ or $f_2$, whichever is closest to $f_v$. The pitch error is thus defined as $(f_d-f_v)/(f_2-f_1)$, which is the error normalized to fractions of a semitone. A running sum of the (normalized) pitch errors is kept in the variable err_sum, and a running sum of the magnitudes of the normalized pitch errors is kept in err_mag_sum. When it is time to indicate an average pitch error, the latter is computed as err_sum normalized by N_pitch (the number of pitches detected since the beginning of the evaluation period). The highest average pitch error is 1.0. Similarly, the average sharpness/flatness for the performance, in fractions of a semitone, is computed as err_mag_sum divided by N_pitch.

This particular embodiment of the PPEM logic could be used for displaying the average pitch error (and magnitude) continuously, or at the end of the performance as indicated by the pressing of a button or by extended inactivity by the player. If it is displayed continuously, it should be updated every so often, for example every five seconds.

The average pitch error can be indicated to the player in any number of ways, such as through a bank of seven LED's such as shown in FIG. 2. Only one LED is to be turned on at a time, and the center LED signifies approximately zero average pitch error. The average pitch error is indicated by another bank of seven LED's, where the lowest average pitch error is signified by only one LED being on and the highest average pitch error possible by having them all lit.

Note that the performance measure of the pitch control does not have to be with respect to semitones. Alternatively, the discrete pitches used for comparison could be the nodes of a particular major scale or of a particular blues scale, as selected by the appropriate modal button 1*c*.

Expressive Parameter Controls

A key aspect of the Vocolo is that, unlike almost all other musical instruments, one's hands are not needed to control the pitch. Instead, they are free to control other aspects of the performance, in particular, to provide unique expressions. This is particularly desirable for a wavetable-based electronic synthesizer, which can often sound repetitive and monotonous due to the rather limited repertoire of wavetables. In the following, a distinction is made between an expressive control and an expressive parameter. An expressive control is the actual mechanical device that interfaces with the player to control the sound expression. On the other hand, the expressive parameter is a parameter in the sound synthesis module (SSM) determined by the position of the corresponding expressive control.

An expressive control also has the characteristic that it returns to its nominal position when not acted upon by the user. In other words, that it is effectively a spring return device. The primary expressive parameters are:

volume (tremolo)

pitch (vibrato)

timbre

These three expressive parameters can also be combined, or coupled, to yield a distinct expressive parameter. For example, the volume and pitch could be coupled into one expressive parameter to be controlled by one expressive control, providing a more distinctive vibrato. It is also to be understood that there are many forms of timbre.

Expressive controls: the following methods can be used to control the above expressive parameters. Each of these consists of a control member that is movable with respect to the Vocolo housing 11.

Mechanical wheel: this is like the "bend wheel" found on many electronic keyboards.

Mechanical slider: a member that moves in translation.

Flexure beam: the deflection of an elastic beam.

Wiggle bar: The wiggle bar 1*d* (see FIG. 3) is a solid bar hinged to the body of the Vocolo body at one end and spring loaded such that the bar returns to a preferred (neutral) position when not touched. This is similar to the vibrato bar found on many electric guitars which changes the pitch of the strings by changing the tension on them. The player simply wiggles the wiggle bar to control the corresponding expressive parameter.

Shaking the Vocolo itself (causes motion of cantilevered weight within the Vocolo structure).

A number of different sensor types can be used to measure the position of the movable member such as a potentiometer, LED proximity sensor, Hall Effect sensor, capacitance proximity sensor, inductive proximity sensor, strain gauge (for measuring the deflection of a beam) and so forth. These are to be incorporated with the appropriate conditioning electronics as well as an A/D converter to digitize the signal for use in the Sound Synthesizer Module (SSM). Alternatively, a digital sensor such as an optical encoder could be used to measure position of an expressive control, thereby bypassing the need for an A/D converter. The methods for interfacing any of these types of sensors to provide a digital representation to the microprocessor (and thus to the SSM) is well known to the art.

Algorithmic Means for Expressive Control

Some preferred physical interfaces for expressive controls have been described. A few preferred algorithms for implementing these controls are now set forth.

Suppose it is desired to implement vibrato with the wiggle bar, that is, to change the pitch played by the instrument a small amount in real-time by wiggling the wiggle bar. A simple method for providing pitch expression is to set:

$$f_{p,exp}=kf_p(P(t)-P_n) \tag{10}$$

where $f_p$ is the pitch that would be played without the expression, i.e. corresponding to the detected pitch, or to the output of the semi-discrete function), k is a constant, $P_n$ is the nominal value of the expression parameter, and $f_{p,exp}$ is the expressed pitch to be played by the instrument. The best time to use this particular expression is when the Vocolo is in the discrete or semi-discrete pitch mode, and to apply the expression, e.g. wiggle the wiggle bar, only when the player's voice is on a flat landing of the semi-discrete function. When implemented in this fashion the Vocolo can produce an especially pure tone because the effect of voice waver is eliminated.

As indicated previously, a particular expressive parameter is determined by the digitized reading from a sensor for its corresponding expressive control member, and that each expressive control member has a corresponding nominal or neutral position. The nominal control position should correspond to a nominal (or median) value of the corresponding expressive parameter. However, the output of the sensor is often not exactly the same each time the expressive control returns to it's nominal (neutral) position. Hence, it is desirable to have a calibration routine activated periodically to reset the expressive parameter to its nominal value. The preferred calibration routine is to set the nominal (neutral) position to the current position if the following two conditions are met: a) the position has changed very little for some small pre-designated amount of time, and b) the current position is within some small range of the neutral position.

Pitch Error Mitigation

No pitch detection method is perfect. Occasionally pitch errors occur. A pitch error is likely to be fairly significant, e.g. an octave low or high. Such abrupt changes in pitch are presently called pitch jumps, and they can lead to an instrument sound that is scratchy and rough. In the preferred approach, called Pitch Error Mitigation (PEM), which is to be incorporated into the sound synthesis module, i.e. the SSM.

The key feature of most synthesis methods as far as the PEM method is concerned is that the sound sample produced by the synthesis method at time t for a given note can be expressed as $S(t-t_a, f(t), \underline{p}(t))$, where $t_a$ is the time of the attack of the note, f is the desired pitch of the note, and $\underline{p}$ is a vector of parameters determined by the player controls (such as loudness). For most synthesis methods, such as wavetable playback, each note has at least two distinct phases, such as the attack and sustain phases. The latter phase involves a segment which is replayed repeatedly (called the loop portion) when the note is sustained for a long time. In the following $\underline{p}(t)$ is not included in the expressions, but it should be clear to anyone skilled in the art how to include this portion.

More formally, the setting is as follows: the pitch detector detects a series of pitches $f_v(t)$ until at some time $t=t_J$ a newly detected pitch is significantly different than the previously detected pitch, i.e.

$$\frac{|f_v(t_J)-f_v(t_J-1)|}{f_v(t_e-1)}>\varepsilon \tag{11}$$

where the vertical bars "|.|" represent the absolute value, and where $\epsilon$ is a small constant, e.g. 0.1. That is, a pitch jump occurs.

The preferred method for mitigating the unpleasant effect of the pitch jump is as follows: the instrument sound wave for the pitch just prior to the pitch jump continues to play, but fades out in a linear fashion to zero loudness in a pre-specified elapsed time period $\Delta t_F$ (a preferred value of $\Delta t_F$ is 10 msec). During the same elapsed period the instrument sound wave for the new (significantly different) pitch is faded in from zero volume to the current volume (or loudness). This simultaneous fade-in, fade-out process is henceforth referred to as a PEM fade (process). In equation form the PEM process is described by:

$$\begin{aligned} S_{inst}(t) &= S_{inst,1}(t, f_v(t)); \text{ if } (t \le t_J) \\ &= gS_{inst,2}(t, f_v(t)) + (1-g)S_{inst,1}(t, f_v(t_J-1)); \text{ if } (t_J < t \le (t_J+\Delta t_F)) \\ &= S_{inst,2}(t, f_v(t)); \text{ if } (t > (t_J+\Delta t_F)) \end{aligned} \tag{12a}$$

where g is the fade factor:

$$g \equiv \frac{(t-t_J)}{\Delta t_F} \tag{12b}$$

and where $S_{inst,1}(t,f_v(t))$ is the sample generated by the synthesis software at time t according to the pitch just prior to the pitch jump (note that after $t_{J-1}$ this pitch stays constant and equal to the pitch at $t_{J-1}$), $S_{inst,2}(t, f_v(t))$ is the sample generated by the synthesis software at time t according to the pitch played after the pitch jump, $t_J$ is the time at which the pitch jump occurs, and $S_{inst}(t)$ is the actual sample played at time t.

If the instrument synthesis is accomplished by wavetable playback, then $S_{inst,1}$ and $S_{inst,2}$ likely come from different wavetables during the PEM fade, as the pitch jumps are usually larger than the nominal pitch range of a single wavetable. In any case, it is preferred that the wavetable sound playback for $S_{inst,2}$ start at the same depth, i.e. the same number of samples after the note attack $t_a$, as $S_{inst,1}$ was upon the pitch jump. For example, if $S_{inst,1}$ was midway in to the attack portion of its wavetable at the time of the pitch jump, then the wavetable playback for $S_{inst,2}$ should start midway in the attack portion of its wavetable.

It is possible, if not so likely, that yet another pitch jump can occur during the PEM fade of Equation 12. The preferred approach for dealing with this situation is to first determine whether the current pitch is close to the pitch detected just prior to the first pitch jump. If it is then the original PEM fade process of Equation 12 is reversed (or "undone").

More formally, $$\begin{aligned} S_{inst}(t) &= gS_{inst,2}(t, f_v(t)) + (1-g)S_{inst,1}(t, f_v(t_J)); \text{ if } (t_J < t \le t_{SJ}) \\ &= g'S_{inst,2}(t, f_v(t)) + (1-g')S_{inst,1}(t, f_v(t_J)); \text{ if } (t_{SJ} < t \le (t_{SJ}+(t_{SJ}-t_J))) \\ &= S_{inst,1}(t, f_v(t)); \text{ if } (t > (t_{SJ}+(t_{SJ}-t_J))) \end{aligned} \tag{13a}$$

where g' is the new fade factor:

$$g' \equiv g(t_{SJ}) + \frac{(t-t_{SJ})}{\Delta t_F} \tag{13b}$$

and where $t_{SJ}$ is the time of the second pitch jump, and $g(t_{SJ})$ is the value of g from Equation 12b at the time of the second pitch jump.

If the new pitch is not close to the pitch just prior to the first pitch jump (by definition it is not close to the last detected pitch either), then it is preferred to superimpose yet another PEM fade process on top of the currently ongoing PEM fade process. In particular, the $S_{inst}(\ )$ produced from the original PEM fade, i.e. from Equation 12, is substituted for $S_{inst,1}(\ )$ for the new PEM fade, and $S_{inst,2}(\ )$ for the new PEM fade is the instrument sound at the new (significantly different) pitch. It is noted that the odds of the second pitch jump occurring (during an ongoing PEM fade) partly depends on how often the pitches detected. For the preferred pitch detection method (PBAC), the time period between successive pitch detections corresponds to the time period between strong peaks in the filtered sound data, usually on the order of one millisecond.

For the short period of the PEM fade (preferably around 10 msec) it is very unlikely that a third pitch jump occurs. However, the present approach can easily be extended to handle this case, or for that matter, to the case where an arbitrary number of PEM fades overlap, by generalizing the approach just described for two overlapping PEM fades (by one skilled in the art).

A flowchart outlining the logic for implementing PEM is shown in FIG. 9. A new sound sample is output at each time step (t=0,1,2 . . . ). Decision box 51 skips the jump test (Equation 11) if the just-detected pitch is the first one in a new note, e.g. corresponds to a note attack. Decision box 53 uses Equation 11 for the test of a pitch jump. If the answer in decision box 55 is "no," then the first PEM fade is implemented via Equations 12a and 12b. If the answer for decision box 65 is "yes," then either a new PEM fade is started according to Equations 12a and 12b but with $S_{inst}(\ )$ from the original fade substituted for $S_{inst,1}(\ )$ for the new PEM fade (as described above), or the original PEM fade is reversed according to Equations 13a and 13b.

As stated above, it is unlikely that a second pitch jump occurs during an ongoing PEM fade. An alternative to providing overlapping fades (as described above) is to allow the jump to occur, i.e. to use the $S_{inst,2}(\ )$ for the most recent pitch jump to be the played sound samples. This approach likely leads to a click in the sound output, but if such instances are rare then this result may be new tolerable.

Auto-accompaniment

In the Reference Patent Application, a Vocolo that included auto-accompaniment was set forth. This accompaniment could be comprised of nothing but rhythmic (atonal) components such as drums, and different rhythmic patterns could be selected from a selector switch means located on the Vocolo body. Furthermore, the tempo of the accompaniment could be altered through another control means on the Vocolo such as a potentiometer or selector switch. The auto-accompaniment is to be stored in the Vocolo as a timed sequence of notes to be played by different synthetic instruments (such as drums), and may involve the playing of more than one instrument at a time, i.e. polyphonic. The accompaniment may also be stored in the Voice-driven Instrument Protocol (VDI) set forth in the Reference Patent Application.

For some applications, it might be desirable to have two separate physical volume controls: one for the instrument being controlled by the voice, and the other for the auto-accompaniment. Alternatively, one volume control could be for the entire sound, and the other for the voice-controlled instrument.

Mechanical Auto-rhythm

When a performer holds and plays the Vocolo, the instrument sound is transmitted through the body of the Vocolo and can be felt by the hands, offering an interesting visceral component to the experience. A means to expand this visceral experience, called the electric drum, is now set forth.

The electric drum produces physical vibrations (or pulses) and mechanical sounds corresponding to a desired tempo. The electric drum could be active in conjunction with or without an audio auto-accompaniment.

The electric drum does not necessarily need to produce an audible sound since its vibrations can be felt with the hands. It is preferred that the electric drum be comprised of an electromechanical actuation means driving a moveable member, the latter coming into contact with some solid portion of the Vocolo body when the electric drum is activated.

FIG. 10 shows one embodiment of an electric drum incorporating a solenoid. The plunger 61 of The solenoid causes the head 62 to strike against a solid portion of the Vocolo body 63 upon activation of the solenoid coil 64. When the coil is not activated, the plunger is retracted by extension spring 65.

Alternatively, the electric drum could consist of an electric motor that rotates an unbalanced wheel, similar to a pager motor (but much slower), thereby using inertial force to transmit the vibrations.

Sequence Recording and Playback

It is desirable for the player to be able to create note sequences that can be played back automatically. This can allow the player to review his performance. It can also allow the player to play a solo simultaneously with the played back sequence, i.e. to jam with himself An advantage of the Vocolo in this regard is that the recording is intrinsically compressed: instead of having to record the instrument sound for every sample output, only pitch and loudness (and timbre if desired) information need be recorded at relatively low data rates.

First a mode where the recording is referenced to a background rhythm is described. This description is provided in conjunction with FIGS. 11 and 12. The advantage of this approach is that the playback is automatically synchronized with the background rhythm, resulting in a steady beat when the sequence is played back repetitively.

For the preferred approach, a single button, called the recording start/stop button, is used to begin and end the recording, e.g. one of the modal buttons 1*c* in FIG. 3. This button may also initiate the playing of the background rhythm, which can be in the form a simple drum beat, or something more elaborate. It is understood that a means can be provided to the player to allow for adjustment of the background beat rate.

The preferred logic for the sequence recording is shown in FIG. 11. The play/record button is pushed to initialize the sequence recording. However, the actual recording does not begin until the player makes his or her first note attack. The state of decision box 71 is determined by the background rhythm means, such as from the SSM, and achieves a logic value of "true" for the time step corresponding to a quarter note downbeat. A quarter note implies that the beat is within a range that is comfortable for the player, e.g. the rate that is comfortable for tapping the foot.

Upon the player's first note attack, the elapsed time from the last beat to the attack is tested to see whether the attack occurs just before the next beat to come. If the latter is true, i.e. if the value for said decision box 73 is true, then the time of the beginning beat of the recording (t_beat_start) is set equal to the time of the next beat to come (in box 74), otherwise it is set to the time of the last beat played (box 75). This accommodates the not so uncommon case where the recording begins with a note attack just before the first beat, that is, for a lead-in note.

Once the time for the beginning beat is established, the actual note recording is started (see below) and the time of the note start is recorded in t_note_start(n_notes), where n_notes is the index for the note (n_notes=1 initially).

To end the recording the player presses the record/play button just prior to the beat he wants to serve as the first downbeat of the playback. Upon this action, if a note is currently being played (and thus recorded) the recording is terminated and control is passed to the playback logic.

The logic for the sequence playback is shown in FIG. 12. The first time through the playback sequence, the time of the first beat for the playback, t_beat_start, is set to the time for the first beat of the recording plus n_beats*t_del_beat. From this point on, the elapsed time from the first beat of the playback (t−t_beat_start) is compared to the recorded times for the note onsets (and endings) to instigate the playback (and cutoffs) of the notes (boxes 81 and 83, respectively). Note that the elapsed time for the first note may actually be negative if it is a lead-in note as described above. Decision box 84 terminates the playback of the sequence when the elapsed time has reached the combined set of beat intervals for the recording. Thus, during a repeated playback of recorded sequence, the sequence is substantially always synchronized with respect to the (n_beats) beats of the recording. The playback sequence then repeats over and over again until terminated by the player. One way to perform the actual recording is to use the following two-dimensional arrays:

$$f_v_rec(i,j)=f_v(t) \tag{14a}$$

$$L_rec(i,j)=L(t) \tag{14b}$$

where the i index refers to ith note of the recording (bounded by attacks and note turn-offs), the j index to the $j^{th}$ sample recorded for the $i^{th}$ note, f_v(t) and L_v(t) are the detected pitch and loudness at the time t, f_v_rec(i,j) and L_rec(i,j) are the respective records of the pitch and loudness, and The recordings are taken at even intervals (after the time of the each attack) and at a rate sufficient to produce a smooth output sound of the instrument during the playback, e.g. every 5 msec.

It may also be desired to record other parameters of the performance, such as the instrument identification, or the value expressive parameter. These can be recorded in the same manner as the pitch and loudness described above.

The above method for sequence recording and playback can easily be extended to handle multi-layered recording, where the player wants to record an initial sequence according to the above description and then record another sequence on top of the original sequence. It is desirable to provide the player the ability to initiate the second recording with the record/play button so that he has time to make preparations. Similar to the first recording, the second recording can begin upon the first attack after pressing of the button.

Note that the method for recording a sequence does not have to be as elaborate as that just presented. Another approach is to take a record of the performance as described above (Equations 14a–14c) without any reference to a background rhythm.

Voice Input Means—The Cup Mouthpiece

In the Reference Patent Application the funnel microphone was introduced and described. In this section the terms funnel microphone and cup mouthpiece are synonymous. In the Reference Patent Application, several advantages were stated for the cup mouthpiece. These are provided below (items 1–3). An additional advantage is also provided as the fourth item.

allows greater freedom of lip motion, which is important for forming consonant sounds, important for producing a fast sequence of attacks;

forms a better entrance for the sound of the user's singing/humming;

helps to hide the sound of the player's voice, providing a stronger sense of playing an instrument, and finally;

prevents external sounds from entering the microphone and disrupting the voice interpretation functions of the Vocolo.

This subsection describes a cup mouthpiece assembly that incorporates vibration isolation for the microphone and a mouthpiece shape that conforms to the face of the user in the mouth region. FIGS. 13*a*–13*c* show the elements of the preferred embodiment of the cup mouthpiece assembly 101. At the back end of the assembly is the attachment portion 135 for rigidly affixing the cup mouthpiece assembly to the rest of the Vocolo. The cup mouthpiece assembly is comprised of two main portions, the cup mouthpiece cap 102 and the microphone containment subassembly 109. The voice is input to the cup mouthpiece cap as indicated by the arrow 103. The cup mouthpiece cap has a cup-shaped portion 115 that has a rim portion 111 for pressing against the region surrounding the mouth of the user, the rim portion being shaped such as to conform naturally to the region around the mouth.

Precautions should be taken to avoid having sounds from the Vocolo loudspeaker feed back into the microphone, as this can cause errors in the pitch detection. The sound from the loudspeaker can reach the microphone two different ways: 1) through the air, and 2) through the (rigid) body (or housing) of the Vocolo. Item 4 above addresses this situation for sound traveling through the air, i.e. the cup section serves to block out this route for the sound. However, for low notes, such as when the Vocolo is playing a tuba, sound can travel efficiently through the Vocolo housing. Thus, it is desirable to isolate the vibrations of the Vocolo housing from the microphone itself. This isolation is provided by having the microphone 130 supported by the elastic bands 121*a*–121*g* (only a few of the bands are indicated). A rigid carriage assembly 106, which is comprised of two ring members 122*a* and 122*b* adjoined by four rib members 124*a*–124*d*, provides a convenient mount for attaching the elastic bands to the funnel microphone assembly. The carriage assembly fits tightly into the outer shell 110. The cap portion 118 of the cup mouthpiece cap fits tightly onto the outer rim 133 of the outer shell after the carriage assembly is inserted into the outer shell. The ventilation hole 132 in the outer shell provides a pathway for air from the mouth to escape as the user hums into the cup-shaped portion.

Hence, any mechanical vibration of the Vocolo housing is isolated from the microphone via the elastic bands. It is to be understood that extension springs could be used instead of the elastic bands to also perform the vibration isolation. The wires connecting the microphone to the electronics contained within the Vocolo body should be of very fine gauge within the cup mouthpiece assembly to avoid any significant mechanical transmission of vibrations to the microphone through the wires. Affixing a small additional mass to the microphone, such as a small piece of steel or brass can enhance the mechanical vibration isolation.

Voice Input Means—The Tube Mouthpiece

Instead of a cup-style mouthpiece as described in the previous subsection one can employ the tube mouthpiece. FIG. 14*a* shows the tube mouthpiece assembly 101' that incorporates this feature. It is essentially the same as the cup mouthpiece assembly except that the cup mouthpiece cap is replaced with the tube mouthpiece cap 102'. To use the mouthpiece, the user places his lips around the end of the tube 115' and hums, similar to the operation of a kazoo. The user does not have quite the freedom of tongue and lip movement for controlling the sound as with the cup mouthpiece. However, an advantage of this approach is that the breath itself can be used to control the volume because a significant airflow is required to carry the sound to the microphone. Another advantage is that the tube may be easier to clean. FIG. 14*b* shows a view of the back of the tube mouthpiece cap, and shows how the tube end 115" protrudes into the microphone containment subassembly (once the tube mouthpiece cap is pressed onto the latter). This places the airflow containing the sound very close to the microphone, making the microphone more sensitive to the user's voice and thus less sensitive to unwanted external sounds.

Voice Input Means—Microphone with Chin Rest

Another equally preferred embodiment for a microphone support means is shown in FIG. 15. This version does not require the performer to hum or sing into a tube or cup, but to rather sing or hum more directly into the microphone without having the user's lips come into contact to any part of the Vocolo. The microphone 82 is supported by the pedestal 76, which is affixed to some Vocolo portion 73. The bracket 70 supports the chin stop comprised of two extensions 88*a* and 88*b* that extend on opposite side of the chin. The elastic members 92*a* and 92*b* provide a comfortable contact surface for the chin stop against the chin. Thus, by placing the chin stop against the chin, the microphone should be automatically placed in front of the mouth, the microphone also being at some predetermined distance from the mouth, and the position of microphone providing a sanitary and acoustically consistent interface for the Vocolo microphone.

The "Simon Says" Game

The Vocolo can be extended and enhanced with various educational game programs. One such program is the "Simon Says" game, which challenges the player to recall and repeat melodic sequences. In this game, the Vocolo first plays a short melodic sequence to the player, who must then repeat it by singing the sequence back into the Vocolo mouthpiece. If the player repeats the sequence correctly, the Vocolo generates a new, more difficult sequence. The process continues for as long as the player correctly repeats the sequences generated.

There are three major components of the software: (1) creation of the challenge melody, (2) melody production, (3) response recording, (4) response evaluation.

Generation of the Challenge Melody

The challenge melody can be generated either randomly or by table lookup. In both cases, challenges must be ordered by difficulty so that a series of melodies can be generated, each one more difficult than the last. The difficulty of a melody is measured in multiple ways, for example:

length, pitch level, pitch range, interval size, melodic congruity, rhythmic complexity, overall speed, repetition, etc.

Length refers to the number of notes that make up the melody; shorter melodies are easier to remember than longer melodies. Pitch level means how high or low the pitches are; pitches that are very high or low are more difficult to sing. Pitch range refers to how far apart the highest note of the sequence is above the lowest note; melodies that span large ranges are more difficult to reproduce than melodies that are constrained to a small range of notes. Interval size refers to the melody's maximum and average jumps in pitch; small jumps in pitch are easier to sing than large jumps. Melodic congruity refers to how well the notes fall into the standard harmonies of western music; notes that conform to a single musical scale are easier to remember and reproduce than are non-harmonic notes. Rhythmic complexity refers to the combination of rhythmic values in the melody; evenly timed notes falling into regular groups are easier to remember and sing than are notes whose rhythms are variable or do not fall into regular groups. Overall speed refers to the fastest rhythms in the melodies; faster rhythms are harder to reproduce than are slower ones (this metric also works in combination with interval size; fast rhythms over small intervals are much easier to sing than fast rhythms over large intervals—the extreme case is yodeling). Repetition refers to the degree to which pitches, intervals, and rhythms are repeated in the melody; melodies with large amounts of repetition are easier to remember and reproduce than are melodies which are otherwise of the same difficulty but which have no such repetition.

Melodies can be generated by (1) drawing from a predefined library of melodies organized according to their difficulty, (2) constructing a melody from a melody profile. The first case is self-explanatory. The second could for example be done as follows for the eight dimensions of difficulty listed above. A melody profile in the form of an eight-placed vector which represents the difficulty-level for each of the dimensions above, e.g. ( 5,1,4,6,2,5,2,3), describes the overall difficulty of the current melody. If the player's response is correct, the difficulty level of one of the dimensions is increased (either at random or according to a predefined procedure) and a new melody is generated according to the new profile. For example, a melody with a length value of five has five notes; in the other dimensions, higher numbers represent greater difficulty, e.g. larger interval sizes, faster speeds, less repetition, etc.

Playing the Challenge Melody

Once generated, the challenge melody consists of a sequence of pitches and their durations. The sequence, called a template, is a list of note pairs: (pitch1, duration1), (pitch2, duration2), (pitch3, duration3). . . . The pitches of the template are played in sequence by the SSM for the duration specified using the currently selected instrument. In the case that there is a pause, or rest, between notes, the pitch value is zero for the note pair representing the rest.

Response Recording

Recording begins as soon as the melody sequence has finished playing. Recording stops once there is a sufficiently long pause in the player's singing, or when the overall duration of the player's singing has far exceeded the duration of the melody (a preferred value is 30% longer than the duration of the challenge melody), or alternatively when the player presses a button on the Vocolo body predetermined for this purpose. Similar to the sequence recording method described earlier, the beginning of the recording of the response corresponds to the first note (attack) of the actual response of the player.

The recorded information is arranged into a template representing a sequence of note pairs just as for the challenge melody described above: (pitch1, duration1), (pitch2, duration2 ), (pitch3, duration3 ). . . . Each time there is an attack or a release in the recording, a new note pair is added to the template sequence. The duration value of the pair is the number of milliseconds between the note's attack and its release. If there is a gap, e.g. greater than 5 ms, between the release of one note and the attack of the next, then the gap is encoded as a pause, i.e. with a pitch value of zero, just as for the challenge melody. The pitch of the note pair is the average pitch detected during the duration of the note pair, i.e. while the note is sung.

Response Evaluation

Once the template for the player's melody has been recorded, it can be compared to the challenge melody that prompted it. The comparison, described next, results in a yes or no determination as to whether the response template, R, matched the challenge template, C. If the response matches, the Simon Says game continues with the creation of a new, more difficult challenge melody as described above. If the response does not match, the game ends.

The algorithm that determines whether R matches C must be flexible, i.e. it must not require the templates to match exactly and should also allow the strictness of the matching to be modifiable. Matching is therefore a two step process: simplification of the templates, and pattern matching across the simplified templates. One possible method for each of these is described next.

Simplification

Each template of absolute note pairs, $((P_a^1, D_a^1), (P_a^2, D_a^2), (P_a^3, D_a^3), \ldots, (P_a^n, D_a^n))$ is converted to a template of relative-pitch and relative-duration pairs, $((P_r^1, D_r^1), (P_r^2, D_r^2), (P_r^3, D_r^3), \ldots, (P_r^n, D_r^n))$. Each relative-pitch entry, $P_r^x$, is the difference in the two corresponding absolute pitches: $P_a^x - P_a^{x-1}$, where $P_r^1 = 0$.

The duration intervals are scaled according to the number of notes, n, and the total duration of the response, $D_r$:

$$D_r^1 = D_a^1 / D_r$$
$$D_r^2 = D_a^2 / D_r$$
$$\ldots$$
$$D_r^n = D_a^n / D_r$$

It may also be useful to quantize both pitches and durations into larger bins, e.g. nearest semitones (for pitches), and multiples of the shortest duration (for durations).

Pattern Matching

The computer science literature is replete with pattern-matching algorithms that can compare two sequences. One method that works well for the Simon Says game is as follows:

First, make the two templates the same size. If the Response Template is longer than the Challenge Template, the shortest-duration entries are successively removed from the Response Template until it is the same size as the Challenge Template. If the Response Template is shorter, then the templates are considered not to match. Alternatively, the Challenge Template could be shortened in the same way, if a greater degree of flexibility is desired.

Second, Recast the templates as two tables, the Challenge Table and the Response Table, each with three columns and n rows. Each row x is an entry from the template. The first column is the relative pitch, $P_r^x$, the second is the relative duration, $D_r^x$, and the third is the beginning time, $B^x$, where $$B^1 = 0$$
$$B^2 = D_r^1$$
$$B^3 = D_r^1 + D_r^2$$
$$\ldots$$
$$B^n = D_r^1 + D_r^2 + \ldots + D_r^{n-1}$$

Starting with $C^1$ (the first row in the Challenge Table) find row $R^x$ (the closest match in the Response Table) according to some mismatch function M (described below); then let $M^1 = M(C^1, R^x)$, and remove both $C^1$ and $R^x$ from their respective tables. Repeat until both tables are empty, thus creating mismatch values $M^2$ through $M^n$. Now sum these mismatch values, $$M_{total} = \sum_i M^i / n$$

to produce a combined mismatch score, and normalize it by dividing by the number of entries in the table, n. Finally compare the result, $M_{total}$ with a threshold value. If $M_{total}$ is less than the threshold, the match is considered successful and the player proceeds to the next round; otherwise the game ends.

The mismatch function, M, can be as simple as the absolute linear difference between the entries in the rows being compared:

$$M(C^x, R^y) = M(\langle {}^C P_r^x, {}^C D_r^x, {}^C B^x \rangle, \langle {}^R P_r^y, {}^R D_r^y, {}^R B^y \rangle) = k_1 |{}^C P_r^x - {}^R P_r^y| + k_2 |{}^C D_r^x - {}^R D_r^y| + k_3 |{}^C B^x - {}^R B^y|$$

where a, and $k_1$, $k_2$, and $k_3$ are constants.

There are many other ways to compare two sequences and measure how well they matched. Any of these methods work for the purposes of the Simon Says game. Other, more (or less) precise pattern-matching algorithms may be more appropriate for a specific implementation.

Other Games

There are any number of other games that could be created for the Vocolo based on similar concepts, for example:

- A synthesized voice or a small screen directs the player to play (sing) a well-known song. The player's rendition is compared to the stored template for that song and scored for accuracy.
- The Vocolo begins a well-known melody and stops; the player must complete the melody and is scored on the accuracy of his completion (compared against a template stored in the Vocolo).
- The player is directed (by voice or screen) to sing specified intervals, e.g. a perfect fourth up, a minor third down, etc., and the player has to sing or play what was specified and is scored based on the result.

Pitch Correction

As stated previously, no pitch detection method is perfect—occasionally pitch errors occur. Contributing to this situation is the fact that the pitch of the human voice is often ambiguous. After all, pitch is a subjective quantity to an extent. For example, consider the case of the diplophonic voice, which refers to when the voice has a sort of rattle-like quality. A vocal sequence can start out normal and then become diplophonic, generally resulting in a sub-harmonic component one octave below the original pitch. Who is to say which pitch is correct during the diplophonic phase, the original or the octave low version? The preferred embodiment, called multi-channel pitch correction (MCPC), addresses this question. The answer it provides is that the correct pitch is the one that is detected by the pitch detector most often.

For multi-channel pitch correction, one or more hypotheses about the pitch are maintained at any time about the current pitch, and the output of the pitch corrector is the most likely hypothesis at that time. Each hypothesis is referred to as a channel because it usually corresponds to a near-contiguous pitch segment in time. For the diplophonic example given in the previous paragraph, one hypothesis corresponds to the original pitch and the other corresponds to the pitch an octave below this, and as the singer bends his pitch, so do the pitches for each channel. Similarly, other channels typically correspond to other harmonics of the fundamental pitch.

The general approach is as follows: Whenever a new pitch is detected, it is compared to other recently detected pitches. The recent pitches are grouped into categories, or channels. If the new pitch is close to one of the channels, then the new pitch becomes the (current) channel pitch. If it is not close to any channel a new channel is started with the current pitch as the pitch of the new channel.

Each channel has an associated weight which indicates the probability that the pitch of the channel is the correct pitch (to be played). The channel corresponding to the currently detected pitch is called the current channel; all the other channels at that time are called non-current channels. In any case, at each time step the weight for the current channel is incremented and the weights for all the non-current channels are decremented (down to a minimum value of zero). Furthermore, the pitches for the non-current channels are kept current with the current channel by scaling the former according to the latter. Finally, as just expressed, the pitch of the channel with the largest weight is output as the corrected pitch.

The multi-channel pitch correction method is now described with reference to FIGS. 17*a* and 17*b,* for the case of two channels. For PBAC, it is preferred to start the pitch correction logic (at START in FIG. 17*a*) every time a new pitch is detected. For other pitch detection methods such as SBAC, that find the pitch every time sample (or down-sample), it is preferred to call the correction logic less often because the pitch does not change nearly as frequently with respect to the detection rate. The variables used in FIGS. 17*a* and 17*b* are defined as follows:

f_v: currently detected pitch f_v_last: the last pitch detected n_chan_active: the number of active channels i_chan_detect: the identity of the current channel, i.e. the channel corresponding to the currently detected pitch (f_v); the value is zero for channel 0, one for channel 1 f_chan_0, f_chan_1: the pitches for channels 0 and 1, respectively f_chan_0_jump, f_chan_1_jump: the pitches for channels 0 and 1, respectively, corresponding to a pitch jump wt_chan_0, wt_chan_1: the weights for channels 0 and 1, respectively; the weight values range from −20 to 30 (this range is somewhat arbitrary and should be "tuned" for the best results)

f_v_corrected: the value of the corrected pitch (the answer)

When the first pitch is detected, an attack is assumed to have occurred, and box 157 resets the channels. As long as no pitch jump occurs, i.e. as long as the pitch changes are smooth, the logic follows down the left side, i.e. through boxes 151, 152, 153, 154 (and then END). Only channel 0 remains active and the weight for this channel increases (up to a maximum value of 30) each time a new (consistent) pitch occurs.

A pitch jump is detected in box 150, i.e., a jump occurs when the normalized difference in pitches exceeds the small threshold constant. Then box 158 sets n_chan_active=2. Decision boxes 159 and 160 determine whether the current pitch is close to either channel 0 or channel 1, respectively. If the pitch is close to channel 0 (box 159), then i_chan_detect=0, the pitch is updated, and weight for channel 0 is increased (box 152); if the number of active channels is two, then the weight for channel 1 is decreased (box 156). If the pitch f_v is close to channel 1, it is known that there are two active channels and the weights for both channels are updated accordingly. If a pitch jump has just occurred, then the jump values for the channel pitches are saved in box 163. Note that if the current pitch is not close to either channel the logic is reset (box 157) since there are no more channels to ascribe the pitch to.

The pitch correction logic continues in FIG. 17*b,* where the task is to update the pitch for the non-current channel, i.e. for the channel whose pitch does not correspond to the currently detected pitch. The last time the pitch for the non-current channel was detected was at the last pitch jump, and hence the pitch for this channel is updated according to the ratio of the pitches at the pitch jump. For example, assume that at the last pitch jump f_chan_0_jump=100 and f_chan_1_jump=200, and several pitches have been detected since then and have been ascribed to channel 1. If the currently detected pitch is 300, i.e., is 100% higher than the pitch of its channel at the jump, then it is desired to have the pitch for channel 0 to go up 100% as well. This is the function of boxes 171*a* and 171*b:* to keep the non-current channel current with the current pitch.

Once the pitch for the non-current channel is updated as just described, the weights of the channels are compared and the one with the highest value is the corrected pitch (the one to be played). Thus, the corrected pitch corresponds to the channel which has been on (or detected) the most in the recent past because the weight for that channel is the highest. For the somewhat unusual case where channel 0 and channel 1 are detected equally frequently, the corrected pitch oscillates just as it would without the pitch correction, although it may oscillate at a lower rate. Note that if the weight of channel 1 falls below (−20) (box 173), the channel is made non-active (box 174).

Generalization to Multi-channel Pitch Correction

The detailed description above for two-channel pitch correction is generalized to the multi-channel, or N-channel, case. For the multi-channel case it is preferred to keep arrays for the channel pitches and weights, i.e, to have the variables weight_chan(i), f_v_chan(i), and f_v_chan_jump(i) for i=0, 1, . . . (n_chan_active−1).

Once a jump has been detected, the current pitch is compared with all the active channels (as in boxes 159 and 160). If the current pitch is close to one of the channels, then this (close) channel becomes the detected channel, and its corresponding pitch is updated, its weight increased, and the weights for all the other channels are decreased. Also similar to the two-channel case, the pitches for all the channels except the detected channel are kept current with the currently detected pitch by scaling them according to the ratios of the pitches at the pitch jumps. Finally, a comparison test determines which channel has the highest weight and the pitch for this channel is the corrected pitch.

Note that if the currently detected pitch is not close to any of the channels for the general multi-channel case, a new channel is created and n_chan_active is incremented. This assumes, of course, that not all of the channels have been allocated. Otherwise, it is preferred to reset the conditions as for the two-channel case (box 157). When the new channel is created it also immediately becomes the detected channel. Finally, as with the two-channel case, any time the weight for a channel falls below (−20) the channel is eliminated. For the multi-channel approach just described, this necessitates setting weight_chan(i)=weight_chan(i+1), and likewise for the other array variables, for all i>i_elim, where i_elim is the index of the channel to be eliminated.

More detail is now provided regarding the ratios for general multi-channel pitch correction. Suppose a first pitch jump occurs. After this first jump the pitch of channel 0 is kept current according to:

$$f_chan(0) = \left[\frac{f_chan_jump(1)}{f_chan_jump(0)}\right] f_v,$$

just as for the two-channel case. Now suppose a second jump occurs. Then f_chan_jump(0) for the second jump is the pitch for channel 0 (just prior to the second jump) that has been kept current by the previous equation, and after the second pitch jump channel 0 is kept current with the currently detected pitch according to:

$$f_chan(0) = \left[\frac{f_chan_jump(2)}{f_chan_jump(0)}\right] f_v.$$

So the same basic equation that applies to the two-channel case applies to the general multi-channel case.

Alternate Embodiment for Keeping Non-detected Channels Current

The pitch correction logic described in the foregoing does not contain any assumptions about the method for pitch detection other than that a sequence of single pitch values are provided by the pitch detector. However, with the preferred pitch detection method (PBAC), it is likely that a strong peak pair exists that corresponds to a given non-current channel, and thus the pitch for this channel can be updated according the (inverse of the) time between the peaks. This eliminates the need to keep a record of the channel pitches at the pitch jumps, as well as the need to calculate the ratios (such as in box 171*a* or 171*b*). Similarly, for SBAC there is likely to be local maxima in the auto-correlation function that correspond to the non-current channels, and the corresponding lag values can be used to keep the non-current channels updated.

Voice Control of Timbre

A number of methods for detecting formants in voice data are already known. Any of these methods can be employed as a means for expression control. For example, an "oooo" (as in "dew") sound could be used to make a trumpet sound more breathy, while an "ee" sound (as in "seed") could make the tone sound more hard.

The system does not need to detect particular vowel sounds per se. It is sufficient to discriminate one or two spectral features, which may not necessarily correspond to standard vowel sounds. In fact, using a consonant sound, such as the "zzz" simultaneously with a tonic component, i.e. with a well-defined pitch, may be the easiest way to create vocal features which are the easiest to discriminate and less require the simplest lines and computations to discern.

Harmony Generation

A mechanism for using the pitch of the voice ($f_v$) and a button to designate the tonic of a discrete mode scale is described in the Reference Patent Application. Here, we introduce a similar concept: by pressing a button, another note is played simultaneously at a pitch that harmonizes with the original pitch. For example, a button could cause a version of the original sound to be played at a third above the tonic (the current pitch). Another similar button could cause a harmony at a or a fifth above the current pitch. Or, yet another button could cause two additional versions of the current note being played using the latter as the tonic indicator, creating a three-part harmony. A more general version of this feature is to have the harmony parts generated by different wave-tables or synthesis schemes.

Hand-held Vocolo with Separate Battery Pack

The Vocolo described in the Reference Patent Application was substantially self-contained. It may also be desired to provide a package whereby the batteries are contained in a separate package for containing the batteries, thus providing for a more lightweight instrument package. The battery package could be clicked on to the performer's belt or in a small pack around the shoulders or back. A cable connects the battery pack to the Vocolo to transfer the electric power.

AC Adapter

The Vocolo is intended as a self-contained instrument, preferably powered by batteries. However, it is preferred to provide a means such that external power to be provided to the instrument from house current. Either standard house current could be provided to the Vocolo, or DC power to be provided to the Vocolo from a separate DC power transformer (wall wart). The latter approach is preferred because this eliminates the need to have a heavy transformer within the Vocolo itself.

Although the invention is described herein with reference to the preferred embodiment, one skilled in the art will readily appreciate that other applications may be substituted for those set forth herein without departing from the spirit and scope of the present invention. Accordingly, the invention should only be limited by the claims included below.

What is claimed is:

1. A voice-controlled electronic musical instrument, comprising:

a mouthpiece where a user's voice enters;

a voice-to-pitch conversion module, said voice-to-pitch conversion module comprising a pitch detector;

one or more user controls; and one or more sound-reproduction devices coupled to the voice-to-pitch conversion module;

wherein pitch of said instrument changes in response to said user's voice; and any of:

a mechanism for reducing harshness of sound due to jumps in pitch of a purely-discrete pitch; and a mechanism wherein pitch played by said instrument corresponds to pitch detected by said pitch detector according to a semi-discrete mapping function, said semi-discrete mapping function being comprised of substantially flat portions centered about predefined note frequencies, each pair of said substantially flat portions connected by a substantially sloped proportion; wherein said semi-discrete mapping function between pitch played by said instrument and pitch detected by said pitch detector optionally comprises straight-line segments; and wherein locations of said substantially flat portions are optionally set according to a particular tuning, said tuning being adjustable by said player through an interface control.

2. The voice controlled instrument of claim 1, further comprising:

a low-pass filter for evening out waver of said player's voice.

3. The voice controlled instrument of claim 2, said low pass filter further comprising:

a mechanism for resetting said low pass filter when large jumps in pitch are detected.

4. The voice controlled instrument of claim 1, wherein said mechanism for reducing harshness of sound due to jumps in pitch of a purely-discrete pitch uses pitch smoothing.

5. The voice controlled instrument of claim 1, further comprising: means for measuring any of:

average sharpness/flatness with respect to predefined discrete notes; and average pitch error (magnitude) with respect to predefined discrete notes;

wherein said discrete notes may comprises semitones; and wherein pitch of said instrument changes in response to said user's voice.

6. A voice-controlled electronic musical instrument, comprising:

a mouthpiece where a user's voice enters;

a voice-to-pitch conversion module, said voice-to-pitch conversion module comprising a pitch detector;

one or more user controls; and one or more sound-reproduction devices coupled to the voice-to-pitch conversion module;

wherein pitch of said instrument changes in response to said user's voice;

wherein an expressive parameter is controlled with said user's hands;

wherein said expressive parameter corresponds to a degree of expression of a quality of an instrument sound, wherein said parameter is in turn responsive to motion of a mechanical member movably attached to said voice controlled instrument, said mechanical member optionally having a preferred neutral position, wherein said neutral position corresponds to a nominal value of a corresponding expression parameter.

7. The voice controlled instrument of claim 6, wherein the position of said movable member is determined by an electronic sensor; and wherein a signal from said sensor is converted to a digital representation and applied to an instrument synthesis algorithm.

8. The voice controlled instrument of claim 7, further comprising:

a mechanism for determining said expressive parameter from said digital representation, in part, according to a stored estimate of a corresponding expressive parameter for said nominal position;

wherein said stored estimate is periodically re-calibrated according to periods of inactivity of said corresponding expressive control.

9. The voice controlled instrument of claim 7, further comprising:

a mechanism for voice control of timbre.

10. A voice-controlled electronic musical instrument, comprising:

a mouthpiece where a users voice enters;

a voice-to-pitch conversion module, said voice-to-pitch conversion module comprising a pitch detector;

one or more user controls; and one or more sound-reproduction devices coupled to the voice-to-pitch conversion module; and an auto-accompaniment mechanism, wherein said auto-accompaniment mechanism comprises any of:

an electric drum;

means for transmitting pulses or vibrations through an instrument body according to an auto-rhythm signal; and a mechanism for sequence recording and playback said mechanism for sequence recording and playback comprising any of:

a record button to Indicate the desire to record;

means for starting recording when a first note is sung;

means for synchronous or asynchronous recording and playback, wherein if synchronous playback/recording is implemented, sung notes are timed with respect to beats of a rhythmic accompaniment, where a repeated playback is produced with a steady beat through said repeated playback;

means for non-synchronous recording of all notes sung between two presses of a button; and means for allowing user to play another instrument on top of playback;

wherein pitch of said instrument changes in response to said user's voice.

11. The voice controlled musical instrument of claim 10, further comprising:

a harmony generation mechanism;

wherein said user's voice is harmonized by said harmony generation mechanism.

12. A voice-controlled electronic musical instrument, comprising:

a microphone;

at least one of a cup mouthpiece, a tube mouthpiece and a support proximate to said microphone upon which a user may rest his chin;

a voice-to-pitch conversion module, said voice-to-pitch conversion module comprising a pitch detector;

one or more user controls; and one or more sound-reproduction devices coupled to the voice-to-pitch conversion module;

wherein pitch of said instrument changes in response to said user's voice.

13. The voice-controlled electronic musical instrument of claim 12, further comprising:

an auto-accompaniment mechanism.

14. The voice-controlled electronic musical instrument of claim 12, wherein said instrument is hand-held.

15. A voice-controlled electronic musical instrument, comprising:

a mouthpiece where a user's voice enters;

a voice-to-pitch conversion module, said voice-to-pitch conversion module comprising a pitch detector;

one or more user controls;

one or more sound-reproduction devices coupled to the voice-to-pitch conversion module; and any of:

a random pattern generator or table lookup for generating patterns of sounds, wherein a game is provided by which a user attempts to reproduce said pattern;

means for measuring any of:

average sharpness/flatness with respect to predefined discrete notes; and average pitch error (magnitude) with respect to predefined discrete notes;

wherein said discrete notes may comprises semitones; and an auto-accompaniment mechanism;

wherein pitch of said instrument changes in response to said user's voice.

16. The voice-controlled musical instrument of claim 15 wherein said auto-accompaniment mechanism comprises a mechanism for sequence recording and playback.

17. The voice-controlled musical instrument of claim 16, wherein said mechanism for sequence recording and playback comprises any of:

a record button to indicate the desire to record;

means for starting recording when a first note is sung;

means for synchronous or asynchronous recording and playback, wherein if synchronous playback/recording is implemented, sung notes are timed with respect to beats of a rhythmic accompaniment, wherein a repeated playback is produced with a steady beat through said repeated playback;

means for non-synchronous: recording of all notes sung between two presses of a button; and means for a allowing user to play another instrument on top of playback.

18. The voice-controlled musical instrument of claim 15, wherein said instrument is hand-held.

19. A voice-controlled electronic musical instrument, comprising:

a mouthpiece where a user's voice enters;

a voice-to-pitch conversion module, said voice-to-pitch conversion module comprising a pitch detector;

one or more user controls; and one or more sound-reproduction devices coupled to the voice-to-pitch conversion module;

wherein pitch and volume of said instrument change in response to said user's voice; and wherein said pitch detector comprises any of:

a recursive autocorrelation mechanism for computing a low resolution pitch period from down-sampled voice data;

wherein an autocorrelation function value for low resolution pitch along with autocorrelation function values for neighboring pitch values provide a high-resolution estimate of pitch; and a recursive autocorrelation mechanism for computing a low resolution pitch period from a low sample rate stream of voice data;

wherein times of occurrences of peaks are recorded according to a high sample rate stream of said voice data; and wherein a high resolution estimate of pitch corresponds to a most recent pair of peaks whose corresponding time interval most closely matches a resolution pitch value.

20. A voice-controlled electronic musical instrument, comprising:

a mouthpiece where a user's voice enters;

a voice-to-pitch conversion module, said voice-to-pitch conversion module comprising a pitch detector;

one or more user controls; and one or more sound-reproduction devices coupled to the voice-to-pitch conversion module; and any of:

means for mitigating effects of pitch detection errors;

wherein pitch error are signified by a jump in pitch during a played note;

wherein logic is applied if a change in pitch is greater than a predetermined threshold value;

wherein instrument sound upon jump in pitch comprised of a fade-out of an original sound prior to said jump, with a fade-in of a new instrument sound according to a new pitch;

wherein logic is applied if another jump occurs during a fade-in/out sequence; and wherein a sample stream that is fading in after a jump is at a same depth as a sample stream that is fading out at before said jump; and means for reducing a number of pitch jumps to be played by said instrument by maintaining a number of hypotheses about a correct pitch and playing a most likely hypothesis at any given time;

wherein pitch of said instrument changes in response to said user's voice.

21. The voice-controlled musical instrument of claim 20, wherein said instrument is hand-held.

* * * * *